US011056823B2

(12) United States Patent
Suzuki et al.

(10) Patent No.: US 11,056,823 B2
(45) Date of Patent: Jul. 6, 2021

(54) ELECTRIC CONNECTOR

(71) Applicants: I-PEX Inc., Kyoto (JP); NIPPON MEKTRON, LTD., Tokyo (JP)

(72) Inventors: Sho Suzuki, Machida (JP); Atsushi Nara, Tokyo (JP); Takashi Sasaki, Tokyo (JP)

( * ) Notice: Subject to any disclaimer, the term of this patent is extended or adjusted under 35 U.S.C. 154(b) by 0 days.

(21) Appl. No.: 16/621,696

(22) PCT Filed: Apr. 20, 2018

(86) PCT No.: PCT/JP2018/016355

§ 371 (c)(1),
(2) Date: Dec. 12, 2019

(87) PCT Pub. No.: WO2018/230157

PCT Pub. Date: Dec. 20, 2018

(65) Prior Publication Data

US 2020/0194926 A1 Jun. 18, 2020

(30) Foreign Application Priority Data

Jun. 14, 2017 (JP) ..... JP2017-117195

(51) Int. Cl.
*H01R 13/52* (2006.01)
*H01R 13/6581* (2011.01)
*H01R 107/00* (2006.01)

(52) U.S. Cl.
CPC ..... *H01R 13/5202* (2013.01); *H01R 13/521* (2013.01); *H01R 13/6581* (2013.01); *H01R 2107/00* (2013.01)

(58) Field of Classification Search
CPC ..... H01R 13/5202; H01R 13/521; H01R 13/6581; H01R 2107/00
See application file for complete search history.

(56) References Cited

U.S. PATENT DOCUMENTS 7,413,467 B1 8/2008 Lai et al.
9,281,626 B2 * 3/2016 Lin ..... H01R 13/6581
(Continued)

FOREIGN PATENT DOCUMENTS

CN 203859330 10/2014
CN 205985548 2/2017
(Continued)

OTHER PUBLICATIONS

International Search Report dated Jul. 10, 2018 for PCT/JP2018/016355.

(Continued)

*Primary Examiner* — Briggitte R. Hammond
(74) *Attorney, Agent, or Firm* — Soei Patent & Law Firm

(57) ABSTRACT

In an electric connector, a waterproof member having an internal waterproof portion and an external waterproof portion is provided in a main body portion. The internal waterproof portion and the external waterproof portion are integrated. Accordingly, the internal waterproof portion covers exposed portions of an upper contact and a lower contact and prevents water intrusion along the upper contact and the lower contact. In addition, the external waterproof portion prevents water intrusion between the electric connector and an inner wall of an accommodating space of an electronic device by surrounding the entire circumference of the main body portion. Since the internal waterproof portion and the external waterproof portion are integrated in this manner, both internal waterproofing and external waterproofing can be realized with the simple configuration of the single waterproof member in the electric connector.

20 Claims, 21 Drawing Sheets

(56) References Cited

U.S. PATENT DOCUMENTS

| | | | | |
|---|---|---|---|---|
| 9,553,410 | B2 * | 1/2017 | Zhao | H01R 13/6581 |
| 9,742,098 | B2 * | 8/2017 | Zhao | H01R 13/6581 |
| 9,935,393 | B2 * | 4/2018 | Tada | H01R 13/5202 |
| 2004/0063349 | A1 | 4/2004 | Sakiyama et al. | |
| 2011/0189888 | A1 | 8/2011 | Rhein | |
| 2015/0333435 | A1 | 11/2015 | Arai et al. | |
| 2016/0020549 | A1 * | 1/2016 | Chen | H01R 13/5219 439/78 |
| 2016/0064871 | A1 * | 3/2016 | Leng | H01R 24/60 439/607.05 |
| 2016/0329667 | A1 * | 11/2016 | Tsai | H01R 13/5216 |
| 2016/0359242 | A1 * | 12/2016 | Tsai | H01R 13/112 |
| 2017/0179634 | A1 * | 6/2017 | Du | H01R 13/6581 |
| 2018/0040974 | A1 | 2/2018 | Peng | |
| 2018/0054020 | A1 | 2/2018 | Tada et al. | |

FOREIGN PATENT DOCUMENTS

| | | |
|---|---|---|
| JP | H7-226259 | 8/1995 |
| JP | 2000-133370 | 5/2000 |
| JP | 2004-119294 | 4/2004 |
| JP | 2013-519207 | 5/2013 |
| JP | 2014-130691 | 7/2014 |
| JP | 2016-096039 | 5/2016 |
| JP | 6005806 | 10/2016 |
| JP | 2017-021899 | 1/2017 |

OTHER PUBLICATIONS

International Preliminary Report on Patentability with Written Opinion dated Dec. 26, 2019 for PCT/JP2018/016355.

* cited by examiner

ELECTRIC CONNECTOR

CROSS-REFERENCE TO RELATED APPLICATIONS

This application is a 35 U.S.C. § 371 national phase application of PCT/JP2018/016355, filed on Apr. 20, 2018, which claims priority to Japanese Patent Application No. 2017-117195, filed on Jun. 14, 2017.

TECHNICAL FIELD

The present disclosure relates to an electric connector.

BACKGROUND

A waterproof electric connector is known as a type of electric connector. For example, in the configuration that is disclosed in Patent Literature 1 below, each contact of a connector has a fixed portion embedded in a housing made of an insulating resin and a groove is formed as a waterproof shape portion in the surface of the fixed portion. In the connector of Patent Literature 1, water intrusion along the interface between the fixed portion and the housing is blocked by such a waterproof shape portion and the connector is internally waterproofed as a result (hereinafter, also referred to as "internal waterproofing").

In addition, Patent Literature 2 below discloses a configuration in which an elastic material constitutes a waterproof member, the waterproof member is disposed in the outer peripheral portion of a connector, and an accommodating space provided in a housing of a portable device, an information device, or the like accommodates the connector such that the outer peripheral part of the waterproof member and the inner wall of the accommodating space of the housing are in close contact with each other. In the connector of Patent Literature 2, waterproofing between the connector and the housing outside the connector (hereinafter, also referred to as "external waterproofing") is achieved by means of such a configuration.

CITATION LIST

Patent Literature

Patent Literature 1: Japanese Unexamined Patent Publication No. 2014-130691

Patent Literature 2: Japanese Unexamined Patent Publication No. 2017-21899

SUMMARY OF INVENTION

Technical Problem

In the above-described electric connector according to the related art, the internal waterproofing and the external waterproofing are achieved by separate members (that is, the contact and the waterproof member). Accordingly, the configuration of the connector may become complicated, assembly may become complicated, and an increase in cost may ensue in a case where a member for the internal waterproofing and a member for the external waterproofing are combined so that both the internal waterproofing and the external waterproofing are realized.

An object of the present disclosure is to provide an electric connector with a simpler waterproof configuration.

Solution to Problem

An electric connector according to an aspect of the present disclosure includes a connecting portion configured to be connected with an opposite connector, a main body portion positioned behind the connecting portion in a direction of connection with the opposite connector, a conductive contact extending along the direction of connection with the opposite connector with at least a part held by the connecting portion and the other part held by the main body portion. An opening is formed in the main body portion that exposes the conductive contact. The electric connector further includes a waterproof member having an internal waterproof portion that fills the opening of the main body portion and covers an exposed portion of the conductive contact exposed from the opening and waterproofing an interior of the electric connector and an external waterproof portion having an annular shape and surrounding an entire circumference of the main body portion perpendicularly to the direction of connection with the opposite connector, wherein an entire circumference of the external waterproof portion configured to abut against an inner wall of an accommodating space of the electric connector, and waterproofing an exterior of the electric connector, the internal waterproof portion and the external waterproof portion being integrated.

In the electric connector described above, the internal waterproof portion of the waterproof member prevents water intrusion along the conductive contact by covering the exposed portion of the conductive contact in the opening. In addition, the external waterproof portion of the waterproof member prevents water intrusion between the connector and the inner wall of the accommodating space by surrounding the entire circumference of the main body portion. Since the internal waterproof portion and the external waterproof portion are integrated as described above, both internal waterproofing and external waterproofing can be realized with the simple configuration of the single waterproof member in the electrical connector described above.

The electric connector according to another aspect of the present disclosure further includes a conductive member having a plate shape that extends along the direction of connection with the opposite connector and having a part held by the connecting portion. A plurality of conductive contacts are disposed on both front and back sides of the conductive member in a state of being electrically insulated from the conductive member, at least a part of each of the conductive contacts being held by the connecting portion and the other part of each of the conductive contacts being held by the main body portion.

In the electric connector according to another aspect of the present disclosure, wherein the other part of the conductive member is held by the main body portion, wherein the conductive member is exposed from the opening of the main body portion, and wherein the internal waterproof portion of the waterproof member covers an exposed portion of the conductive member exposed from the opening.

The electric connector according to another aspect of the present disclosure further includes a conductive shell having a tubular shape that surrounds the connecting portion and that extends in the direction of connection with the opposite connector.

In the electric connector according to another aspect of the present disclosure, a rear end of the conductive shell is fitted to a front end of the main body portion, and wherein an outer shape dimension of the fitting part in the main body portion increases rearward in the direction of connection with the opposite connector.

In the electric connector according to another aspect of the present disclosure, the external waterproof portion of the waterproof member covers the fitting part between the conductive shell and the main body portion.

Advantageous Effects of Invention

According to the present disclosure, an electric connector with a simpler waterproof configuration is provided.

DESCRIPTION OF EMBODIMENTS

Figure 1:
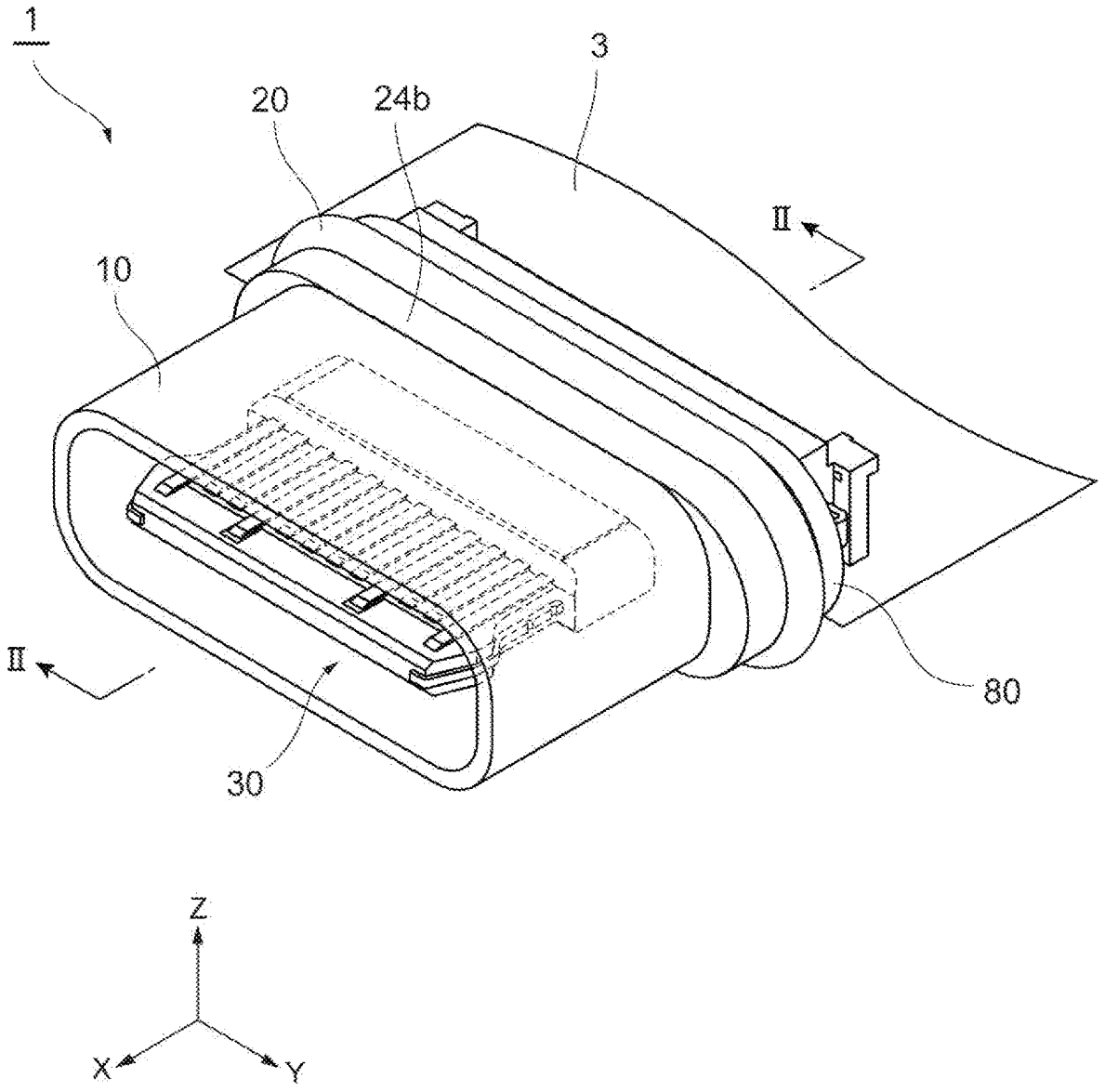
FIG. 1 is a perspective view illustrating an electrical connector according to an embodiment of the present disclosure.

Hereinafter, an embodiment of the present disclosure will be described in detail with reference to accompanying drawings. In the description, the same reference numerals are used for the same elements or elements having the same functions so that the same description does not have to be repeated.

First, an electrical connector 1 according to the present embodiment will be described with reference to FIGS. 1 and 2.

The electrical connector 1 is a receptacle connector attached to an electronic device 2 such as a portable device and an information technology device. As illustrated in FIG. 2, the electrical connector 1 is accommodated in an accommodating space C of the electronic device 2, is fixed to a substrate 3 of the electronic device 2 by solder connection or the like, and is electrically connected to the substrate 3. By inserting a plug connector (not illustrated) as an opposite connector into the electrical connector 1, it is possible to perform electric power supply and electrical signal transmission between the plug connector and the substrate 3. In the present embodiment, the electrical connector 1 is a USB Type-C connector.

Figure 3:
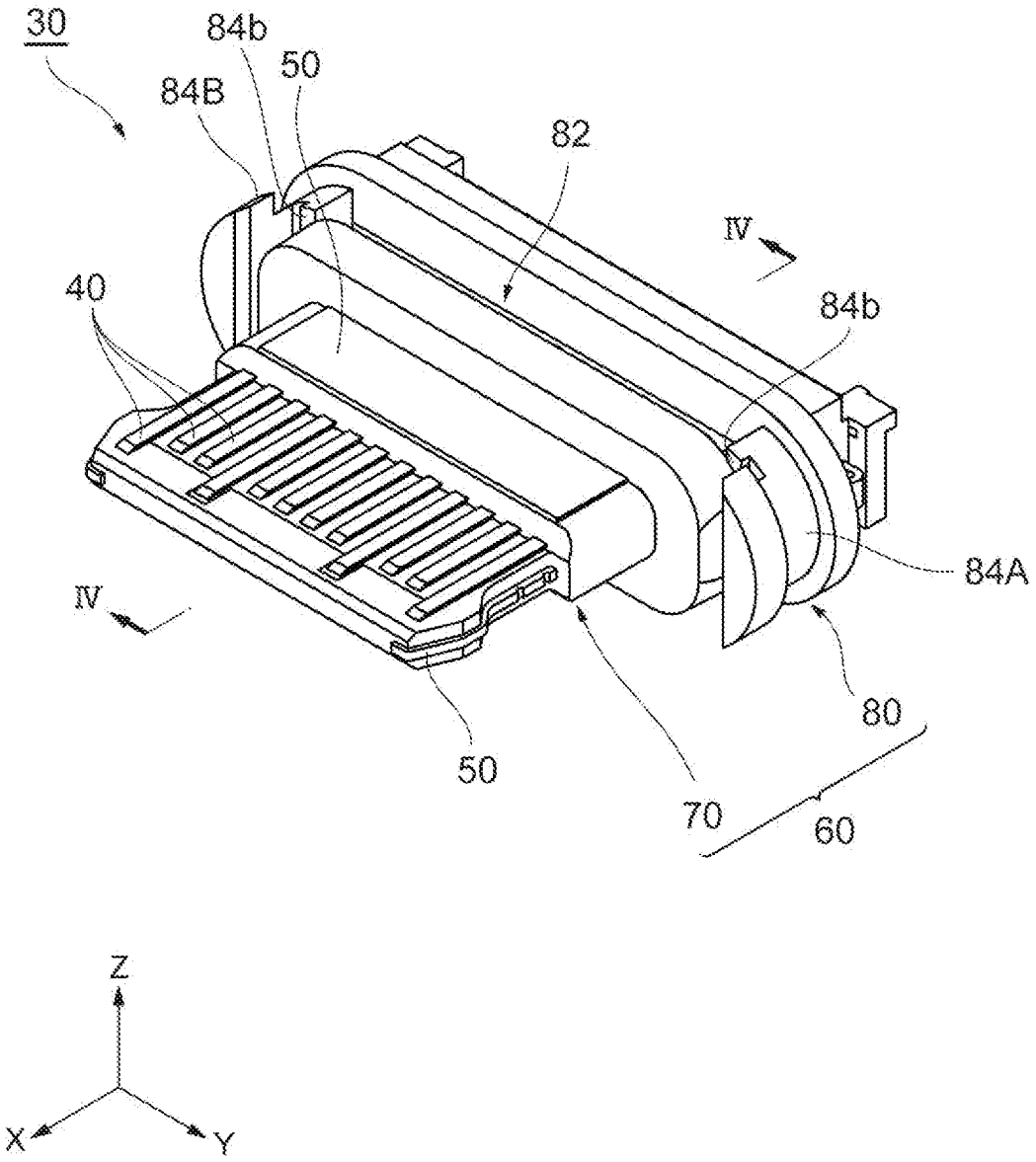
FIG. 3 is a perspective view illustrating a connector main body of the electrical connector in FIG. 1.

The electrical connector 1 and the plug connector are interconnected along a predetermined direction. As illustrated in FIG. 3, in the following description, the direction in which the electrical connector 1 and the plug connector are interconnected will be referred to as an X direction. In addition, in the X direction, the direction toward the plug connector will be referred to as forward and the direction away from the plug connector will be referred to as rearward. The X-direction front part of each member will be referred to as a front portion and the X-direction rear part of each member will be referred to as a rear portion.

As illustrated in FIG. 1, the electrical connector 1 is configured to include a shell 10, a waterproof member 20, and a connector assembly 30.

Hereinafter, the configuration of the connector assembly 30 will be described with reference to FIGS. 3 to 5.

As illustrated in FIG. 3, the connector assembly 30 has a plurality of conductive contacts 40, a plurality of conductive ground plates 50, and a resin molded body 60 integrally bonding the contact 40 and the ground plate 50 to each other.

Each of the plurality of contacts 40 is an elongated member extending along the direction in which the electrical connector 1 and the plug connector are interconnected (X direction). A metal material such as Cu constitutes each of the plurality of contacts 40. As illustrated in FIGS. 4 and 5, the plurality of contacts 40 include a plurality of contacts 42 parallel in a direction orthogonal to the X direction. In the present embodiment, 12 contacts 42 are parallel in a direction orthogonal to the X direction. In the following description, the direction in which the contacts 42 are parallel will be referred to as a Y direction for convenience of description. As illustrated in FIG. 4, each of the contacts 42 has a bent portion 42*a* in which the rear portion in the X direction is bent toward the substrate 3 and a substrate connecting portion 42*b* extending from the lower end portion of the bent portion 42*a* along a main surface 3*a* of the substrate 3 in the surface direction. The substrate connecting portion 42*b* is electrically connected by solder connection or the like to, for example, a signal terminal (not illustrated) disposed on the main surface 3*a* of the substrate 3.

Figure 4:
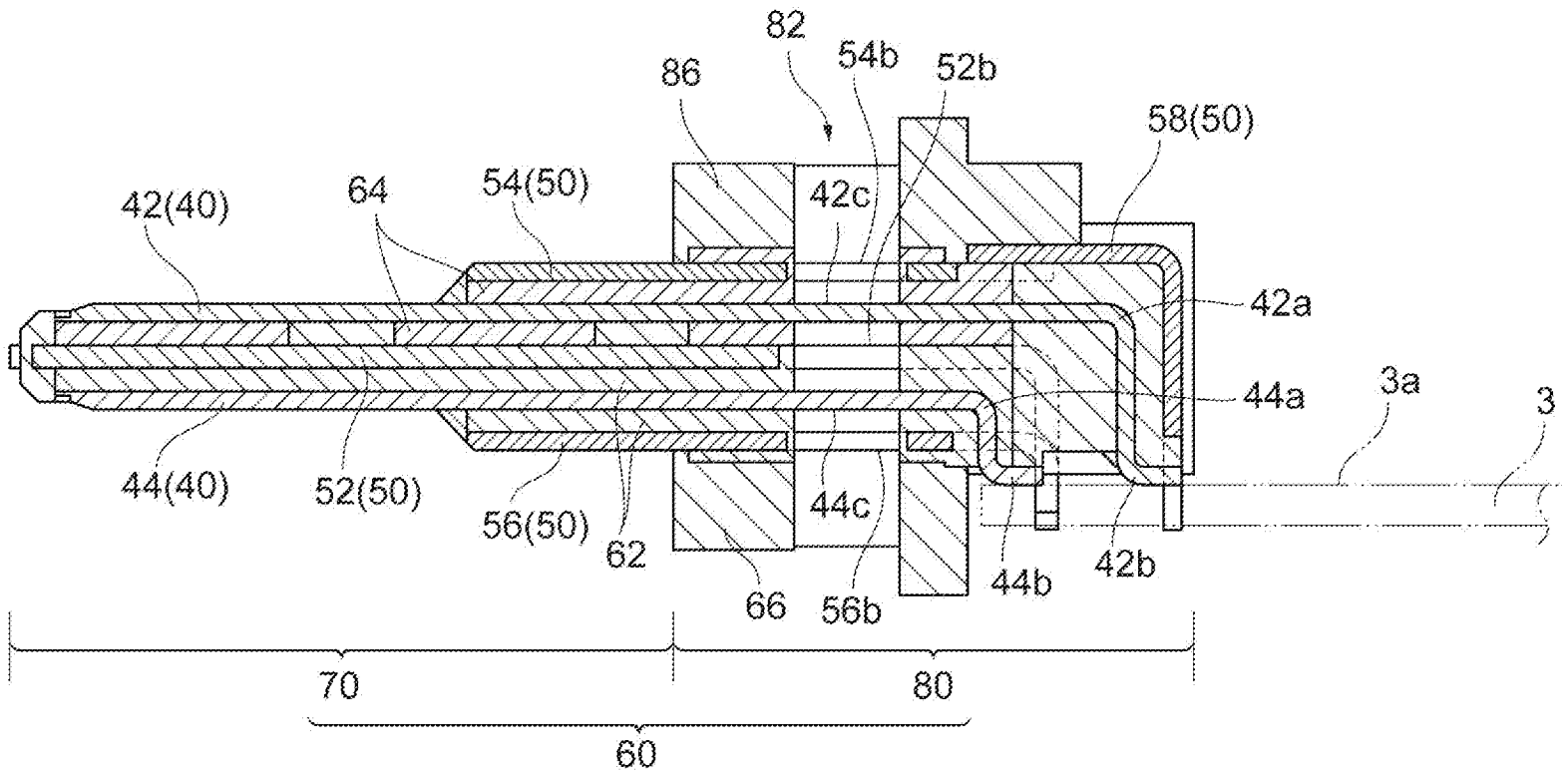
FIG. 4 is a cross-sectional view taken along line IV-IV of the connector main body in FIG. 3.
Figure 5:
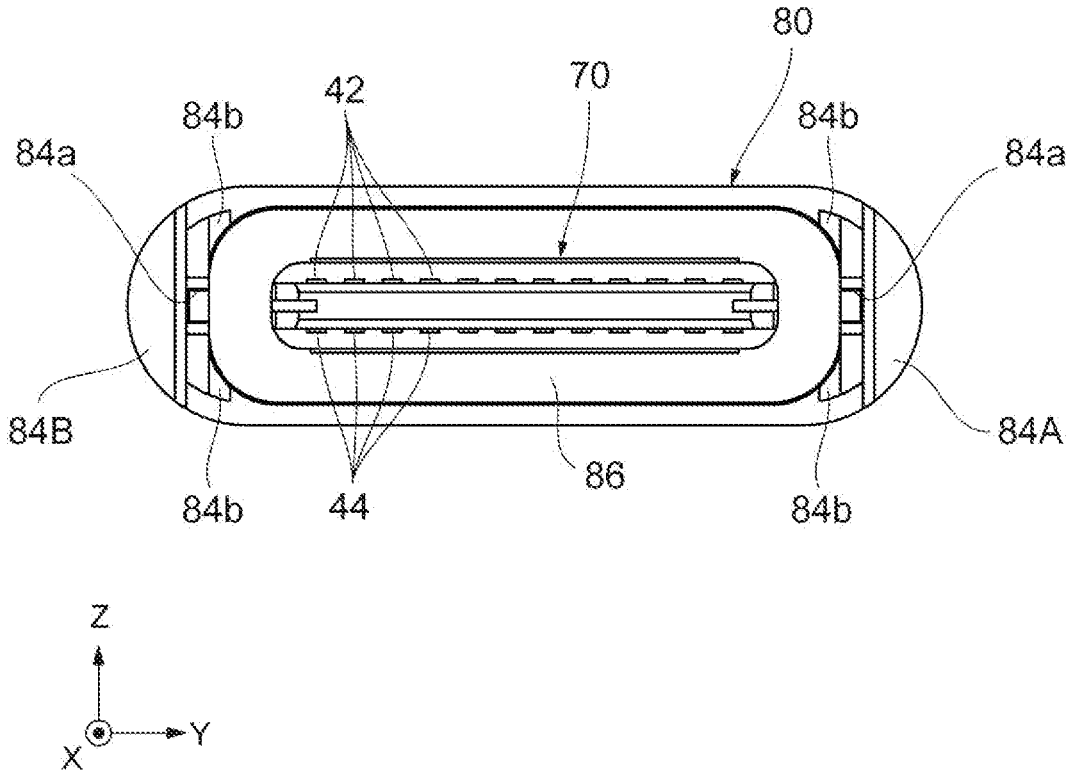
FIG. 5 is a front view in which the connector main body in FIG. 3 is viewed from a direction of connection X.

As illustrated in FIGS. 4 and 5, the plurality of contacts 40 include 12 contacts 44 as well as the 12 contacts 42. The contacts 44 are separated by a predetermined distance in a Z direction, which is orthogonal to the X direction and the Y direction, and extend in the X direction so as to overlap the contacts 42. The contacts 44 are disposed in parallel in the Y direction. In the following description, the direction orthogonal to the X direction and the Y direction will be referred to as the Z direction for convenience of description. In addition, in the Z direction, the side that is far from the substrate 3 will be referred to as an upper side and the side that is close to the substrate 3 will be referred to as a lower side with reference to the main surface 3*a* of the substrate 3. For example, the contact 42 on the side far from the substrate 3 in the Z direction will be referred to as an upper contact and the contact 44 on the side close to the substrate 3 in the Z direction will be referred to as a lower contact. As illustrated in FIG. 5, the X-direction front portions of the upper contact 42 (second contact) and the lower contact 44 (first contact) overlap each other in the Z direction (thickness direction of an intermediate ground plate 52 to be described later). As in the case of the upper contact 42, the lower contact 44 has a bent portion 44*a* in which the rear portion in the X direction is bent toward the substrate 3 and a substrate connecting portion 44*b* extending from the lower end portion of the bent portion 44*a* along the main surface 3*a* of the substrate 3 in the surface direction. The substrate connecting portion 44*b* is electrically connected by solder connection or the like to, for example, the signal terminal (not illustrated) disposed on the main surface 3*a* of the substrate 3.

As illustrated in FIG. 4, the plurality of ground plates 50 include the intermediate ground plate (conductive member having a plate shape) 52, an upper ground plate 54, a lower ground plate 56, and a back ground plate 58, all of which are at ground potential.

Figure 6:
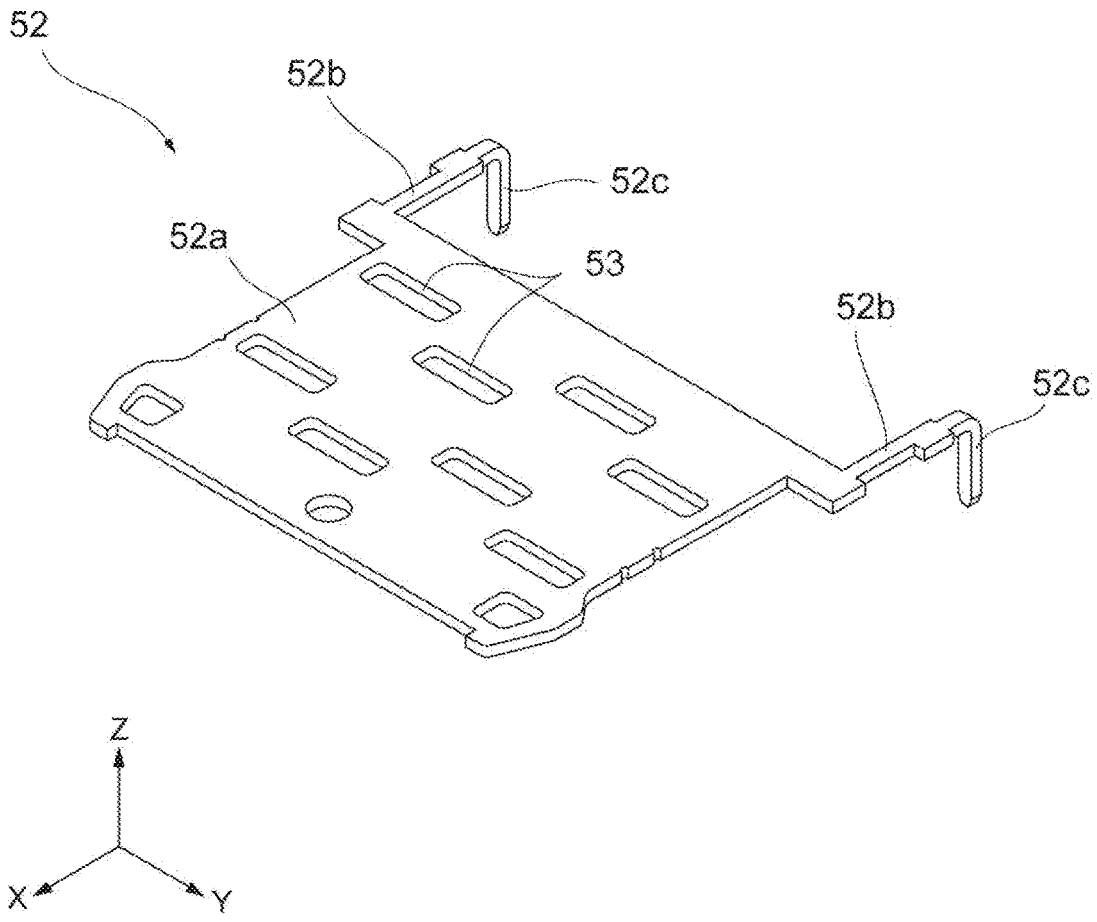
FIG. 6 is a perspective view illustrating an intermediate ground plate in FIG. 3.

As illustrated in FIG. 6, the intermediate ground plate 52 has a plate-shaped portion 52*a* disposed in the front in the X direction, two arm portions 52*b* extending rearward from the plate-shaped portion 52*a*, and a substrate connecting portion 52*c* descending toward the substrate 3 from the rear end of the arm portion 52*b*. The plate-shaped portion 52*a* of the intermediate ground plate 52 is a part extending in parallel to the upper contact 42 and the lower contact 44 between the upper contact 42 and the lower contact 44. A plurality of through holes 53 are provided at the parts of the plate-shaped portion 52*a* where the upper contact 42 and the lower contact 44 overlap each other in the Z direction. Each of the through holes 53 is used so that each of the lower contacts 44 is held with a mold when the intermediate ground plate 52 and the lower contact 44 are disposed in the mold by first insert molding to be described later. The lower end of the substrate connecting portion 52*c* of the intermediate ground plate 52 extends to a position reaching a ground terminal disposed on the main surface 3*a* of the substrate 3.

Figure 7:
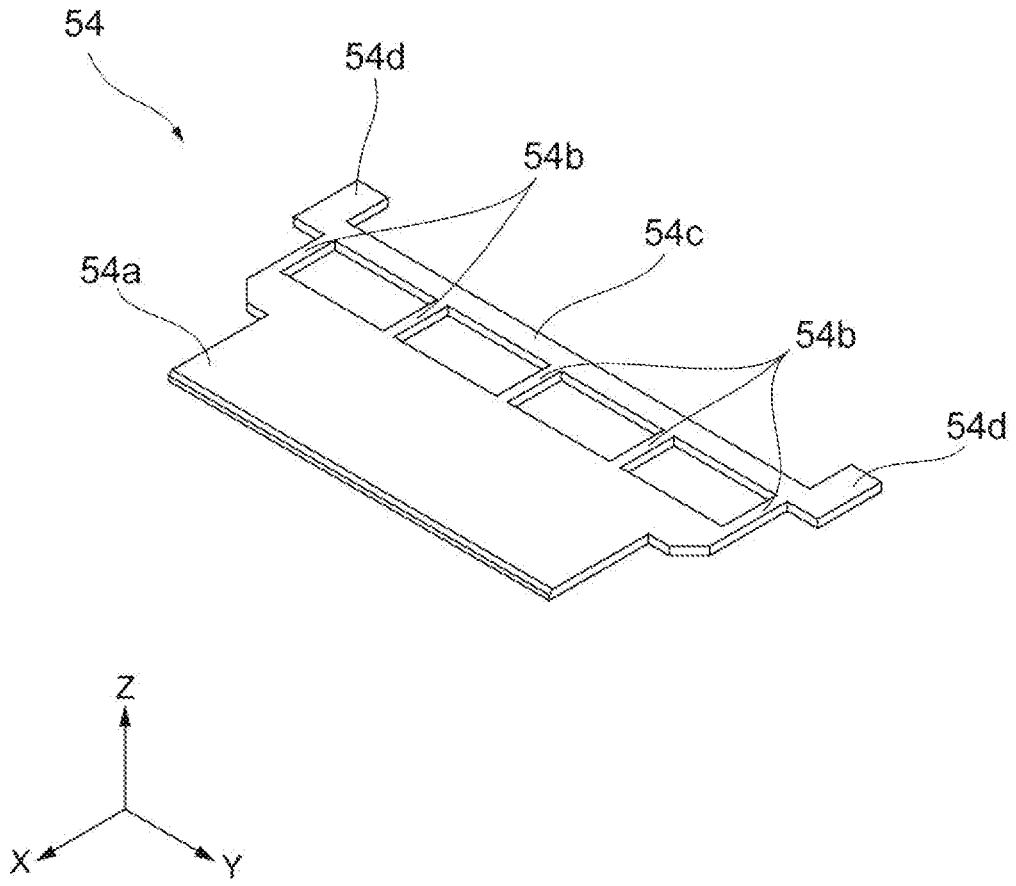
FIG. 7 is a perspective view illustrating an upper ground plate in FIG. 3.

As illustrated in FIG. 7, the upper ground plate 54 has a plate-shaped portion 54*a* disposed in the front in the X direction, five bridge portions 54*b* extending rearward from the plate-shaped portion 54*a* at predetermined intervals in the Y direction, a belt-shaped portion 54*c* extending in the Y direction so as to be connected to all of the five bridge portions 54*b*, and a joining portion 54*d* extending rearward from both Y-direction ends of the belt-shaped portion 54*c* and joined to the back ground plate 58 to be described later. The plate-shaped portion 54*a* of the upper ground plate 54 is a part extending in parallel to the intermediate ground plate 52 in a state where the upper contact 42 is interposed between the plate-shaped portion 54*a* and the intermediate ground plate 52.

Figure 8:
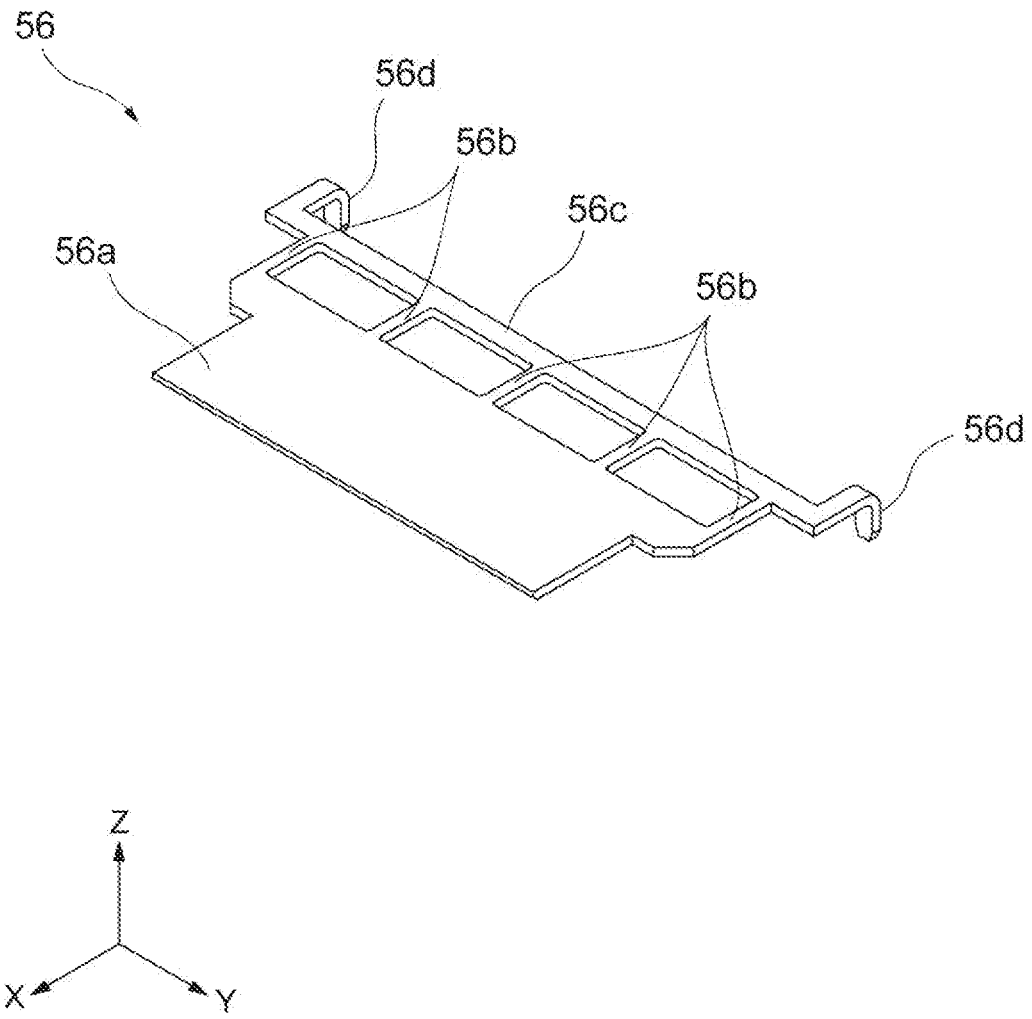
FIG. 8 is a perspective view illustrating a lower ground plate in FIG. 3.

As illustrated in FIG. 8, the lower ground plate 56 has a plate-shaped portion 56*a* disposed in the front in the X direction, five bridge portions 56*b* extending rearward from the plate-shaped portion 56*a* at predetermined intervals in the Y direction, a belt-shaped portion 56*c* extending in the Y direction so as to be connected to all of the five bridge portions 56*b*, and a substrate connecting portion 56*d* descending toward the substrate 3 from both Y-direction ends of the belt-shaped portion 56*c*. The plate-shaped portion 56*a* of the lower ground plate 56 is a part extending in parallel to the intermediate ground plate 52 in a state where the lower contact 44 is interposed between the plate-shaped portion 56*a* and the intermediate ground plate 52.

Figure 9:
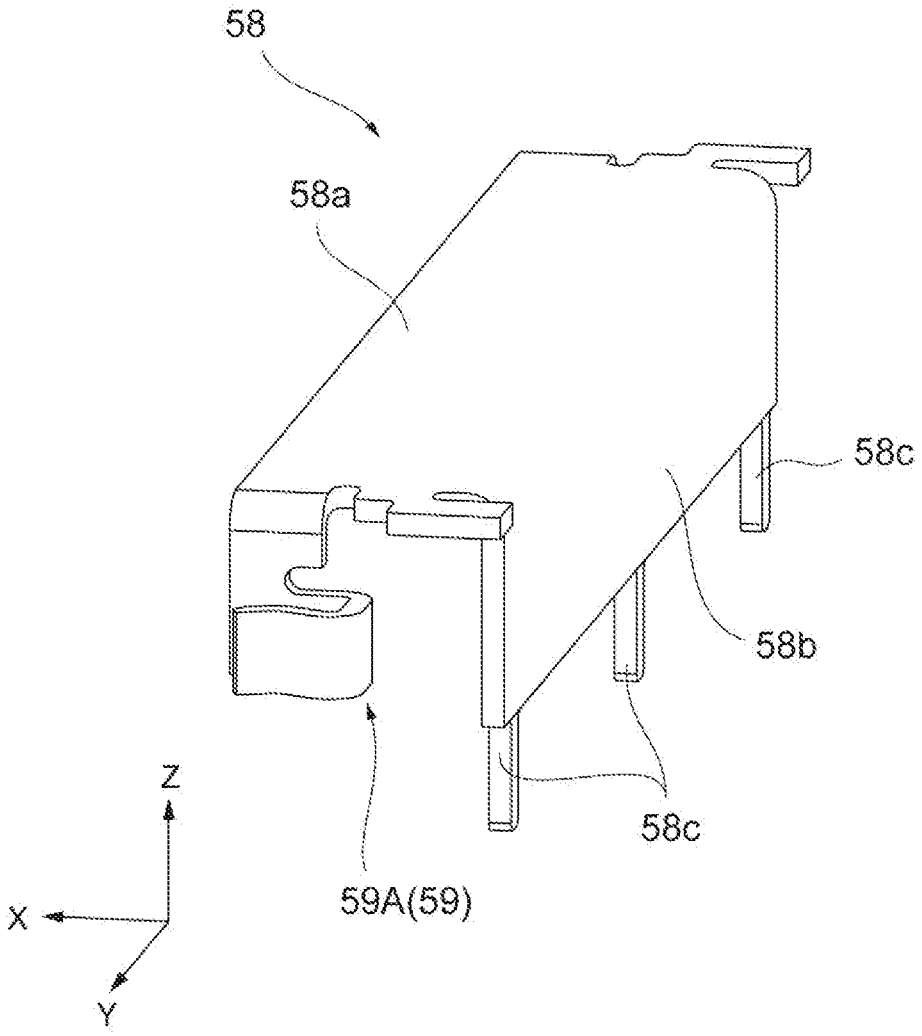
FIG. 9 is a perspective view illustrating a back ground plate in FIG. 3.

As illustrated in FIGS. 4 and 9, the back ground plate 58 has a plate-shaped portion 58*a* extending in parallel to the upper ground plate 54 behind the upper ground plate 54 and joined to the joining portion 54*d* of the upper ground plate 54, a plate-shaped descending portion 58*b* descending toward the substrate 3 from the rear end of the plate-shaped portion 58*a*, and three substrate connecting portions 58*c* extending from the lower end of the descending portion 58*b* to a position reaching the ground terminal (not illustrated) disposed on the main surface 3*a* of the substrate 3. The back ground plate 58 covers the bent portion 42*a* of the upper contact 42 and the bent portion 44*a* of the lower contact 44. By means of the back ground plate 58, it is possible to suppress a situation in which the upper contact 42 and the lower contact 44 are affected by electromagnetic waves from the outside and a situation in which electromagnetic wave noise generated in the upper contact 42 and the lower contact 44 affects an electronic device around the electrical connector 1.

A spring portion 59 connected to extending portions 14A and 14B of the shell 10 to be described later is provided in both Y-direction end portions of the plate-shaped portion 58*a* of the back ground plate 58.

An insulating resin constitutes the resin molded body 60. As illustrated in FIG. 4, the resin molded body 60 holds and fixes each of the plurality of contacts 40 and the plurality of ground plates 50 described above at a predetermined position.

The resin molded body 60 has a connecting portion 70 and a main body portion 80. The connecting portion 70 is a part to be connected with the opposite connector and is positioned in the front of the resin molded body 60 with regard to the direction of connection. The main body portion 80 is a part to be fixed to the substrate 3 of the electronic device 2 and is positioned behind the connecting portion 70 in the direction of connection with the opposite connector.

The connecting portion 70 holds the front portion (a part) of each contact 40 with regard to the direction of connection. Specifically, the connecting portion 70 holds the upper contact 42 on one surface (surface) of the plate-shaped portion 52*a* of the intermediate ground plate 52 such that the upper contact 42 is separated by a predetermined distance from the plate-shaped portion 52*a* of the intermediate ground plate 52. In addition, the connecting portion 70 holds the lower contact 44 on the other surface (back surface) of the plate-shaped portion 52*a* of the intermediate ground plate 52 such that the lower contact 44 is separated by a predetermined distance from the plate-shaped portion 52*a* of the intermediate ground plate 52.

The connecting portion 70 holds the plate-shaped portion 54*a* of the upper ground plate 54 in a state where the upper contact 42 is interposed on one surface of the plate-shaped portion 52*a* of the intermediate ground plate 52. Likewise, the connecting portion 70 holds the plate-shaped portion 56*a* of the lower ground plate 56 in a state where the lower contact 44 is interposed on the other surface of the plate-shaped portion 52*a* of the intermediate ground plate 52. In other words, the plurality of contacts 40 (upper contact 42 and lower contact 44) are disposed on both sides of the intermediate ground plate 52 (conductive member having a plate shape) in a state of being electrically insulated from the intermediate ground plate 52 and with at least one part held by the connecting portion 70 and the other part held by the main body portion 80.

Figure 10:
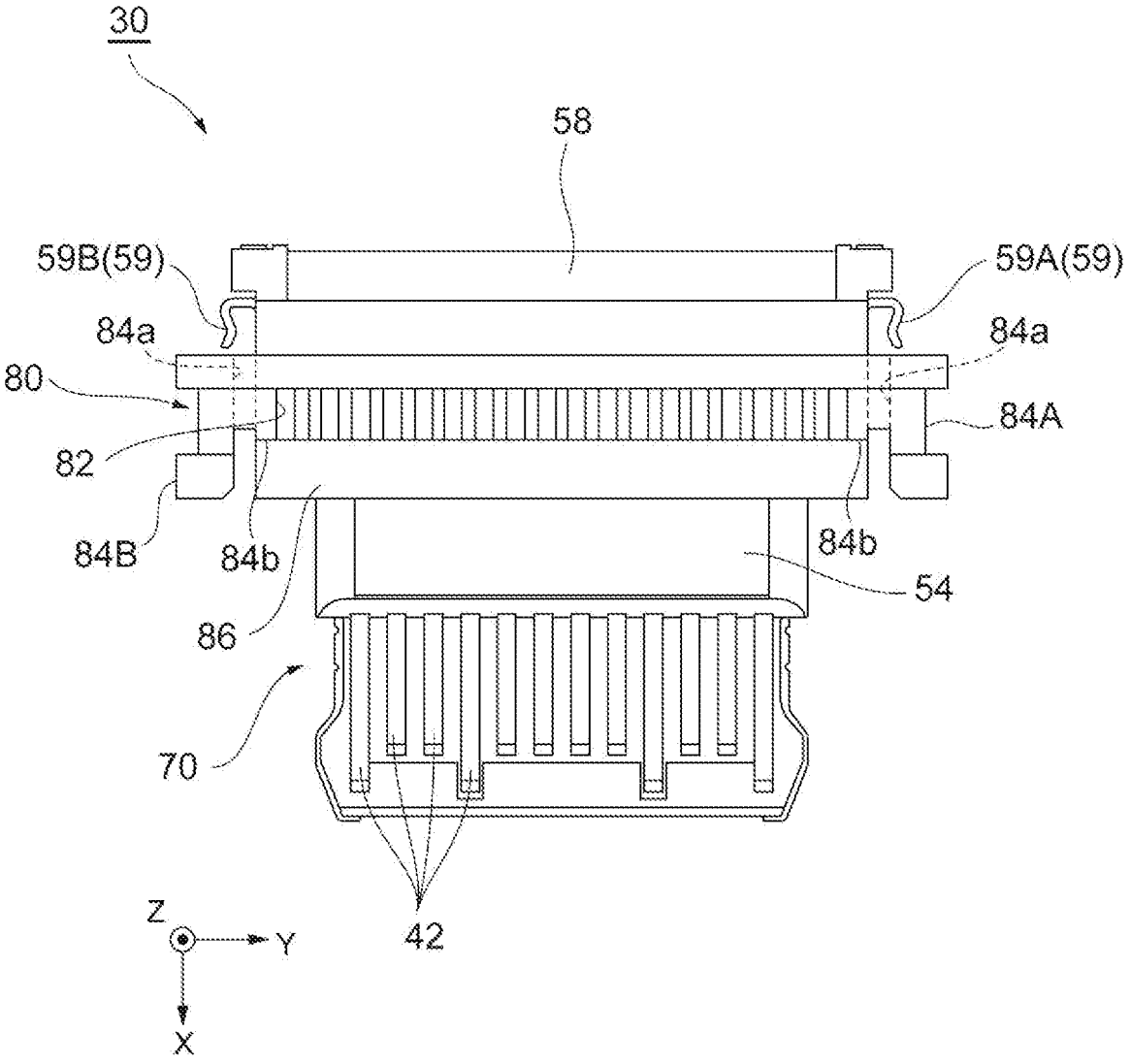
FIG. 10 is a plan view of the connector main body in FIG. 3.
Figure 11:
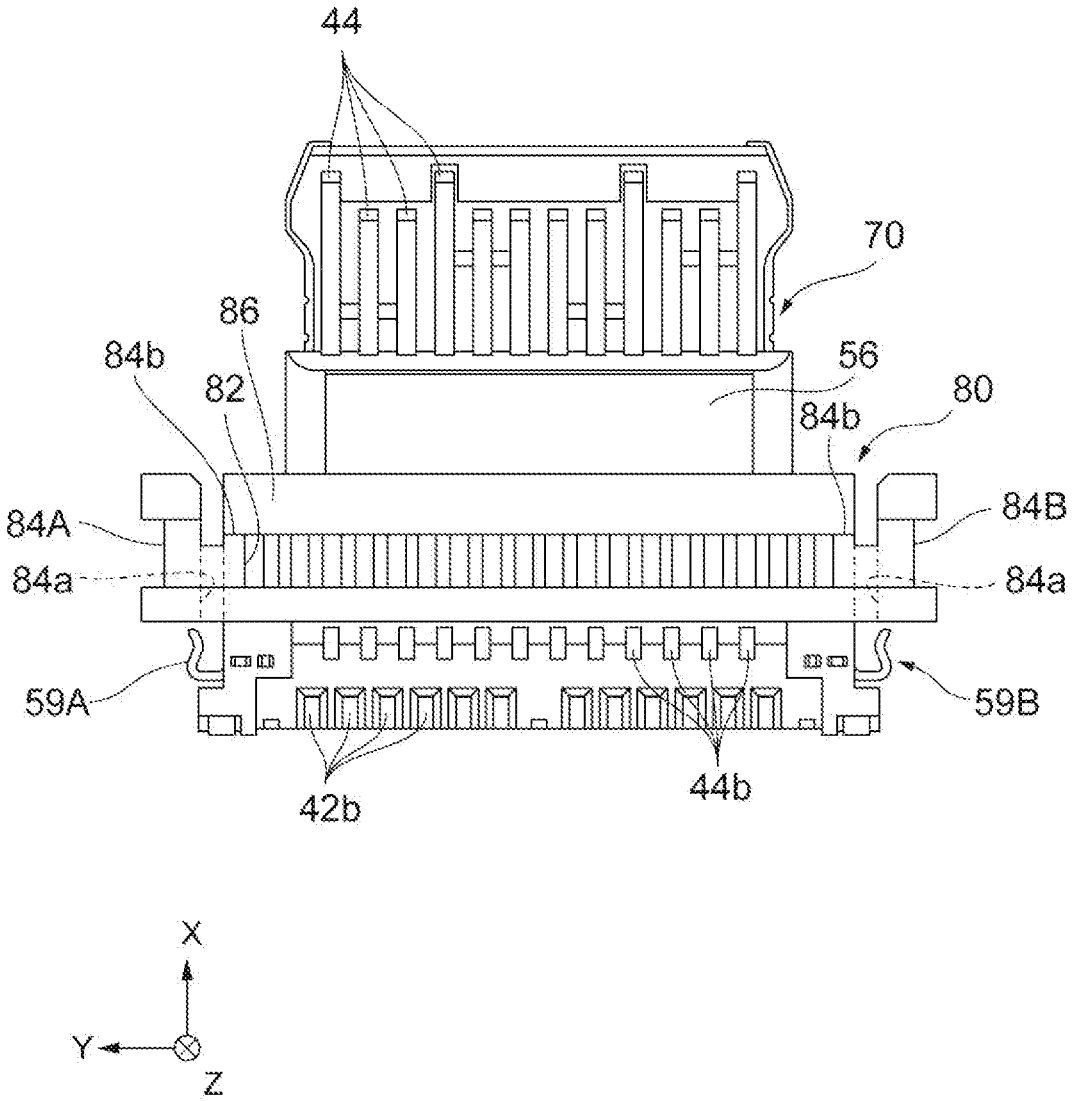
FIG. 11 is a bottom view of the connector main body in FIG. 3.

The main body portion 80 holds the rear portion (the other part) of each contact 40 and each ground plate 50 with regard to the X direction. As illustrated in FIGS. 4 and 10, the main body portion 80 has an opening 82 penetrating the main body portion 80 in the Z direction. The cross-sectional shape of the opening 82 is a rectangular shape extending in the Y direction. A part of the rear portion of each contact 40 and a part of each ground plate 50 are exposed in the opening 82. In other words, a part of the rear portion of the upper contact 42 and a part of the rear portion of the lower contact 44 are exposed from the opening 82 as exposed portions 42*c* and 44*c*, respectively. With regard to the intermediate ground plate 52, the two arm portions 52*b* are partially exposed from the opening 82. With regard to the upper ground plate 54 and the lower ground plate 56, a part of each bridge portion 54*b* and a part of each bridge portion 56*b* are exposed from the opening 82.

As illustrated in FIGS. 3 and 5, the main body portion 80 has a pair of flange portions 84A and 84B disposed at positions sandwiching the opening 82 from the Y direction. Each of the flange portions 84A and 84B extends away from the opening 82 along the Y direction. Each of the flange portions 84A and 84B is provided with a through hole 84*a*, and the extending portions 14A and 14B of the shell 10 to be described later are inserted through the through holes 84*a*.

Next, a procedure for manufacturing the connector assembly 30 will be described with reference to FIGS. 12 to 18.

Figure 12:
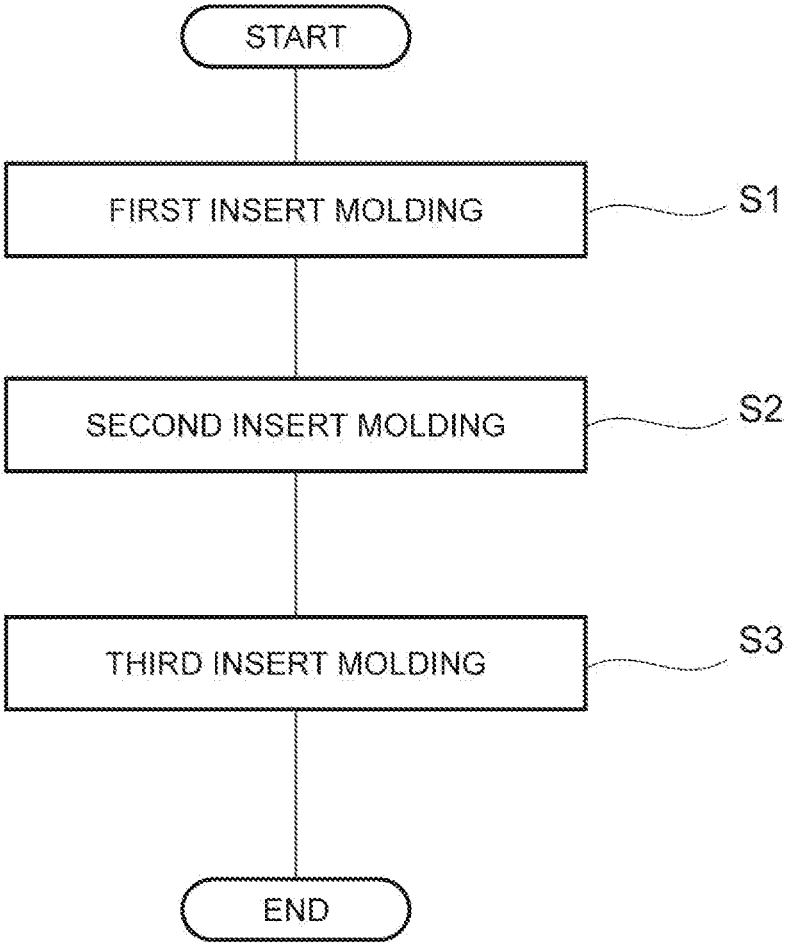
FIG. 12 is a flowchart illustrating a procedure for manufacturing the connector main body in FIG. 3.
Figure 13:
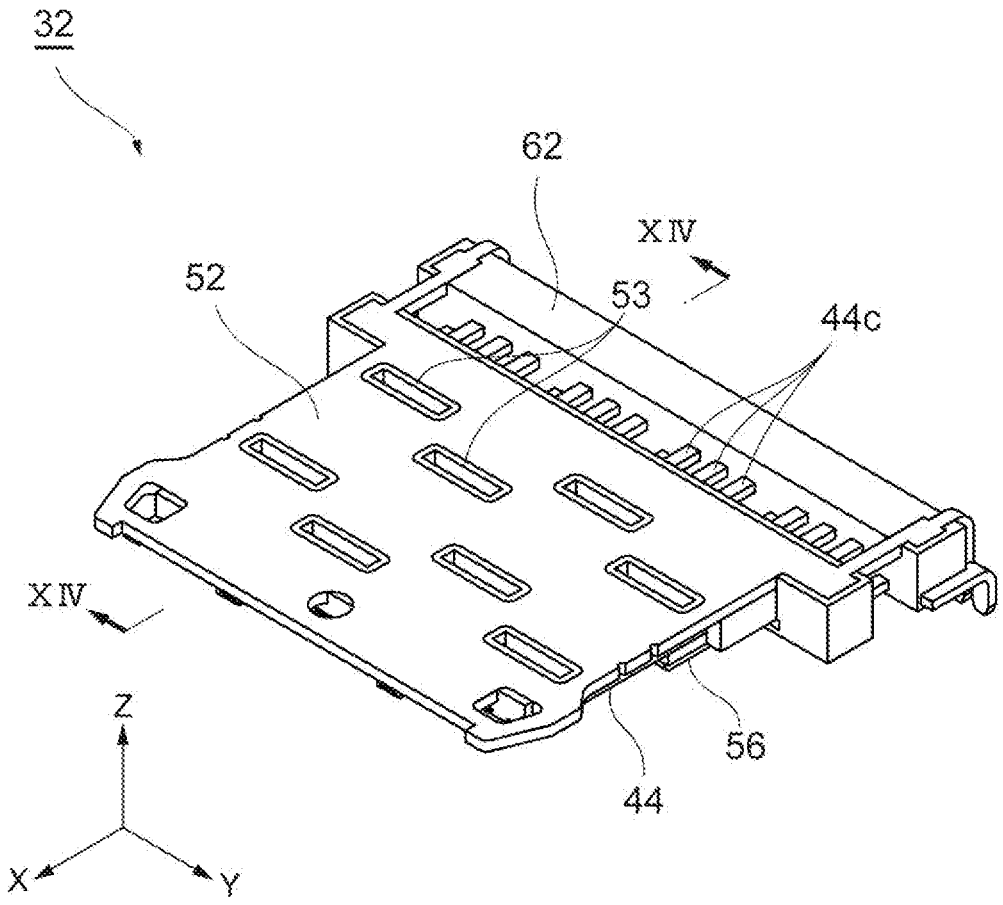
FIG. 13 is a perspective view illustrating a first molded body obtained by first insert molding.

Initially during the manufacturing of the connector assembly 30, the intermediate ground plate 52, the lower contact 44, and the lower ground plate 56 are disposed at predetermined positions in a predetermined mold and the members are integrated by means of a first resin 62 as the first insert molding (Step S1 in FIG. 12). A first molded body 32 as illustrated in FIG. 13 is obtained as a result of the first insert molding. In the first molded body 32, the lower contact 44 and the lower ground plate 56 are held and fixed on the other surface of the intermediate ground plate 52 via the first resin 62.

Figure 14:
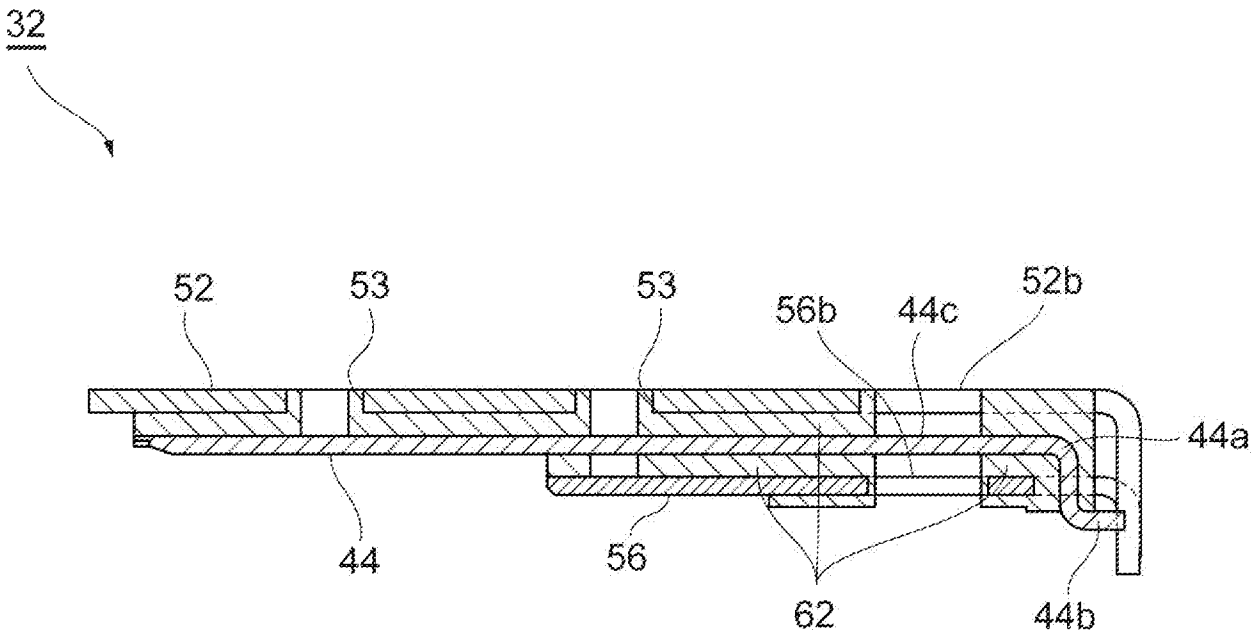
FIG. 14 is a cross-sectional view taken along line XIV-XIV of the first molded body in FIG. 13.

As illustrated in FIG. 14, the first resin 62 is formed between the intermediate ground plate 52 and the lower contact 44 and between the lower contact 44 and the lower ground plate 56. The first resin 62 is not formed in the exposed portion 44*c* of the lower contact 44, a part of the arm portion 52*b* of the intermediate ground plate 52, and a part of each bridge portion 56*b* of the lower ground plate 56 that are exposed in the opening 82 described above.

During the first insert molding, a part of the mold is inserted from above through the through hole 53 provided in the intermediate ground plate 52 and the lower contact 44 and the lower ground plate 56 are held by the part of the mold. Then, a situation in which the lower contact 44 and the lower ground plate 56 deflect toward the intermediate ground plate during the insert molding is suppressed.

Figure 15:
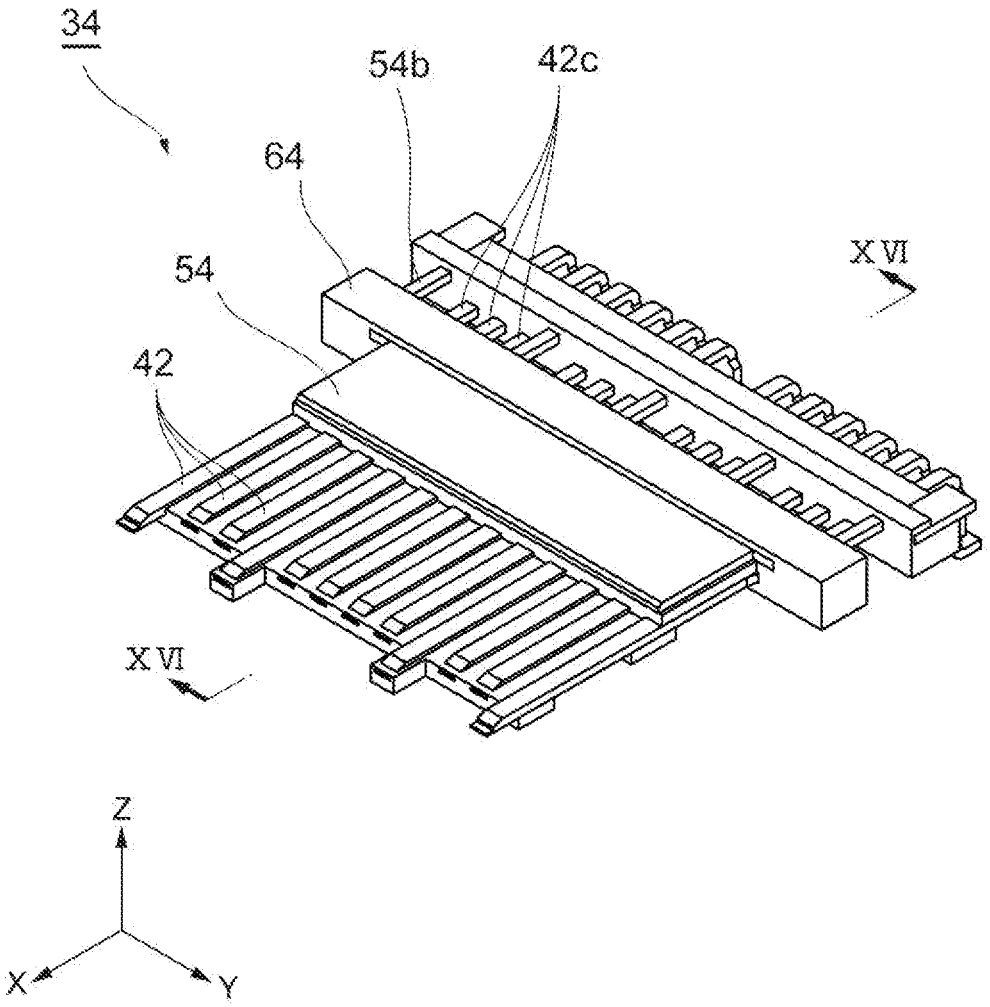
FIG. 15 is a perspective view illustrating a second molded body obtained by second insert molding.
Figure 16:
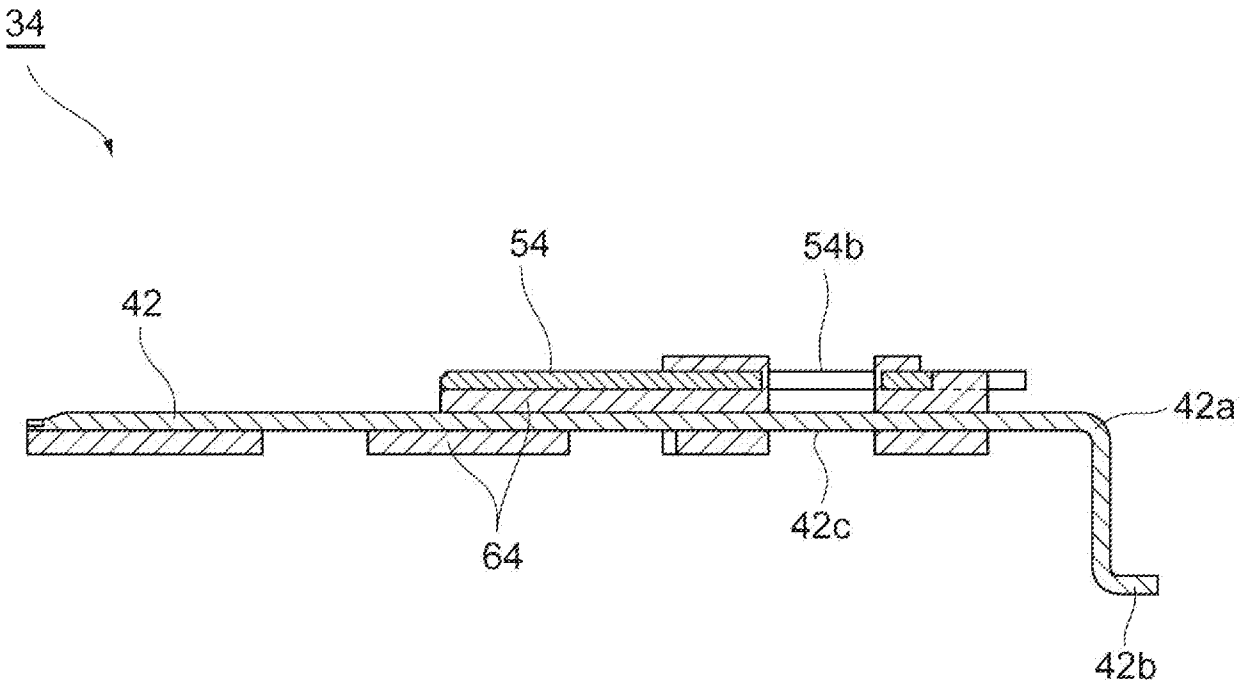
FIG. 16 is a cross-sectional view taken along line XVI-XVI of the second molded body in FIG. 15.

After the first insert molding, the upper contact 42 and the upper ground plate 54 are disposed at predetermined positions in the predetermined mold and the members are integrated by means of a second resin 64 as second insert molding (Step S2 in FIG. 12). A second molded body 34 as illustrated in FIG. 15 is obtained as a result of the second insert molding. As illustrated in FIG. 16, in the second molded body 34, the second resin 64 is formed between the upper contact 42 and the upper ground plate 54 and on the lower side of the upper contact 42. The second resin 64 is not formed in the exposed portion 42*c* of the upper contact 42 and a part of each bridge portion 54*b* of the upper ground plate 54 that are exposed in the opening 82 described above.

Figure 17:
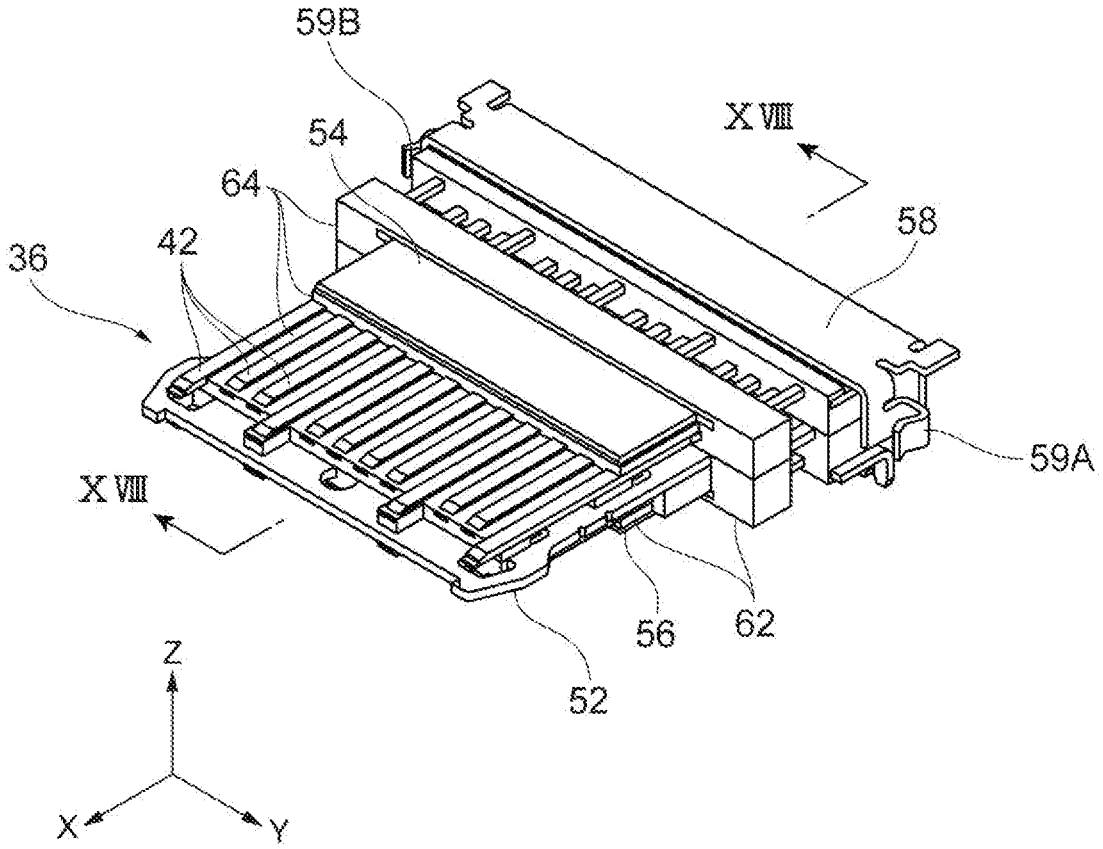
FIG. 17 is a perspective view illustrating a state where the back ground plate is disposed in a molded body set in which the first molded body in FIG. 13 and the second molded body in FIG. 15 overlap each other.
Figure 18:
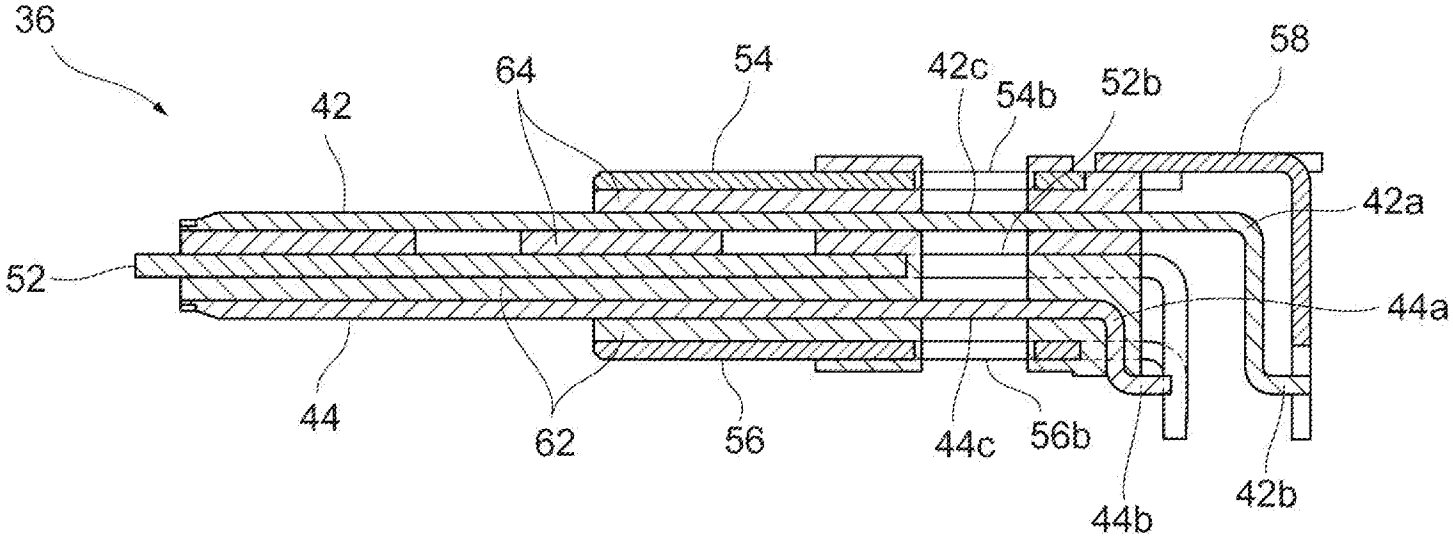
FIG. 18 is a cross-sectional view taken along line XVIII-XVIII of the molded body set in FIG. 17.

After the second insert molding, a molded body set 36 in which the second molded body 34 is disposed on the first molded body 32 is formed as illustrated in FIGS. 17 and 18. As a result, the upper contact 42 and the upper ground plate 54 are disposed on one surface of the intermediate ground plate 52 via the second resin 64. Then, the molded body set 36 and the back ground plate 58 are disposed at predetermined positions in the predetermined mold and third insert molding is performed by means of a third resin 66 (Step S3 in FIG. 12). As a result, the connector assembly 30 described above is obtained.

In other words, the first resin 62, the second resin 64, and the third resin 66 described above constitute the resin molded body 60 of the connector assembly 30.

Figure 19:
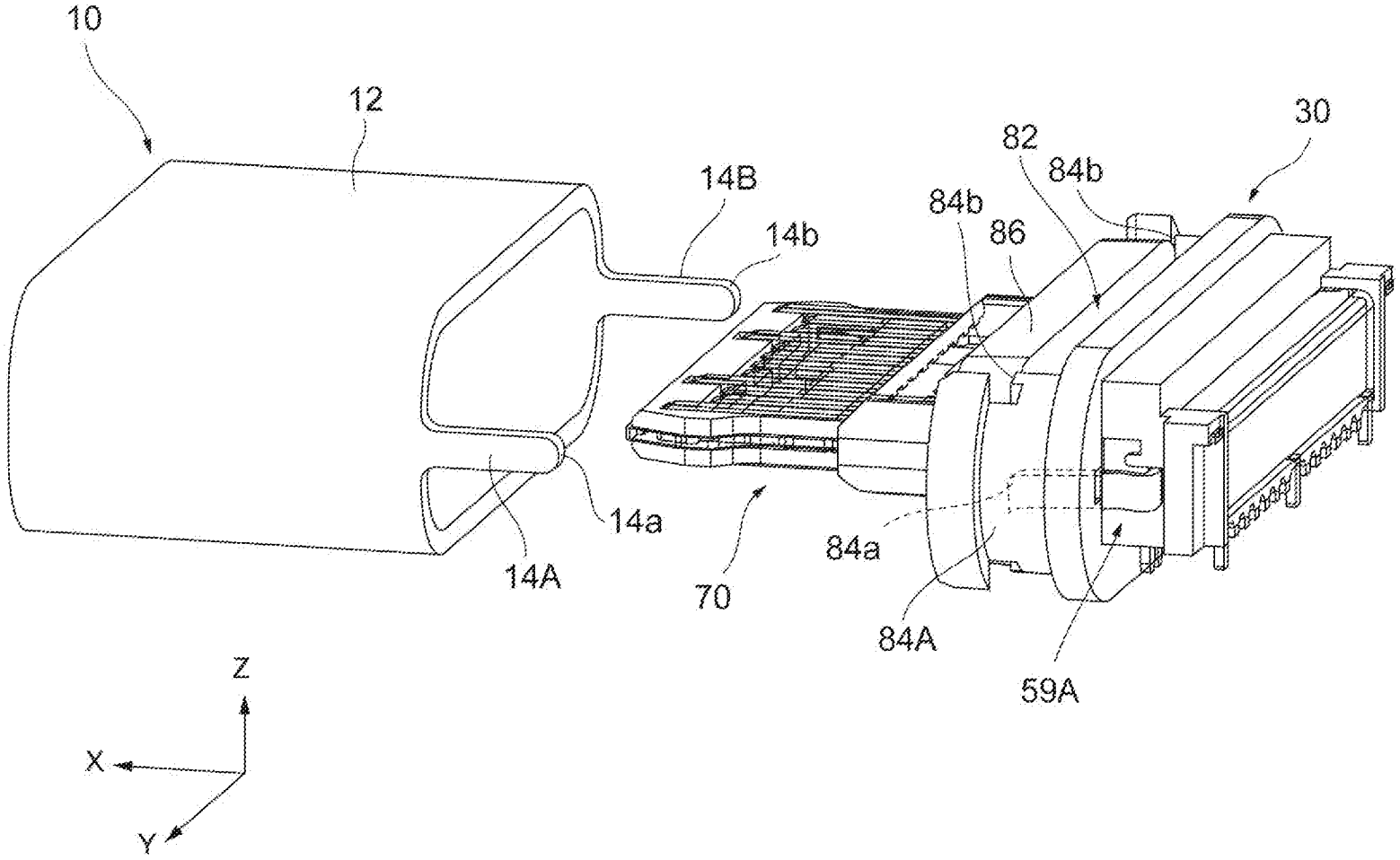
FIG. 19 is a perspective view illustrating how a shell is attached to the connector main body in FIG. 3.

As illustrated in FIG. 19, the shell 10 has a tubular shape with both ends open and a conductive metal material constitutes the shell 10. The shell 10 has a tube portion 12 and the two extending portions 14A and 14B.

The tube portion 12 has a flat shape having an elliptical and annular cross section and extends along the X direction. The tube portion 12 covers the whole of the connecting portion 70 of the connector assembly 30, and the rear end of the tube portion 12 is fitted to the main body portion 80.

The fitting between the tube portion 12 and the main body portion 80 will be described with reference to FIG. 20.

Figure 20:
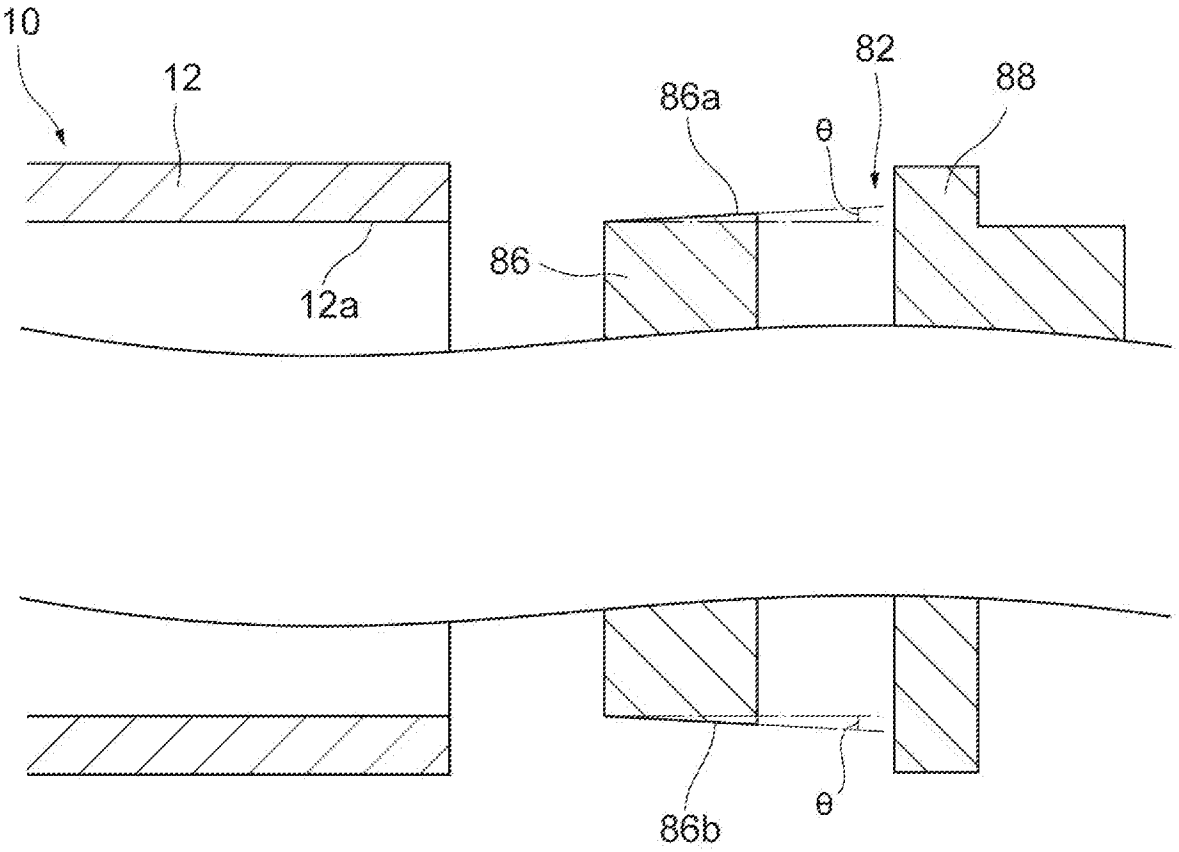
FIG. 20 is a diagram illustrating fitting between a tube portion of the shell and a main body portion of the connector main body.

As illustrated in FIG. 20, a part 86 (hereinafter, referred to as the front main body portion 86) of the main body portion 80 that is positioned in front of the opening 82 is designed such that the outer diameter of the front end of the front main body portion 86 is equal in dimension to the inner diameter of the tube portion 12 or slightly smaller in dimension than the inner diameter of the tube portion and the front main body portion 86 has an outer shape dimension gradually expanding from the front end toward the rear in the X direction. As illustrated in FIG. 20, which is a cross-sectional view, the front main body portion 86 to be joined to the rear end of the tube portion 12 is formed such that the entire circumferential surface that includes an upper end surface 86*a* and a lower end surface 86*b* is inclined by an angle θ with respect to an axis parallel to the X direction.

Accordingly, the stress and the frictional force with respect to an inner peripheral surface 12*a* of the tube portion 12 increase from the front main body portion 86 and the tube portion 12 is firmly fitted to the front main body portion 86 once the tube portion 12 is press-fitted to the front main body portion 86 along the X direction after the tube portion 12 is disposed so as to come into contact with the outer periphery of the front main body portion 86. As illustrated in FIGS. 5, 10, 11, and 19, the main body portion 80 is provided with four abutting portions 84*b* abutting against the rear end of the tube portion 12. The position at which the abutting portion 84*b* and the rear end of the tube portion 12 abut against each other is the rear end position of the front main body portion 86 (or a position in front of the position), and the tube portion is not press-fitted behind the position. In other words, a situation in which the tube portion 12 blocks the opening 82 of the main body portion 80 is avoided by means of the abutting portion 84*b*.

The extending portions 14A and 14B of the shell 10 extend from one end of the shell 10 toward the main body portion 80. Specifically, the extending portions 14A and 14B extend toward the main body portion 80 along the X direction from both Y-direction end portions of the rear end of the tube portion 12.

Figure 21:
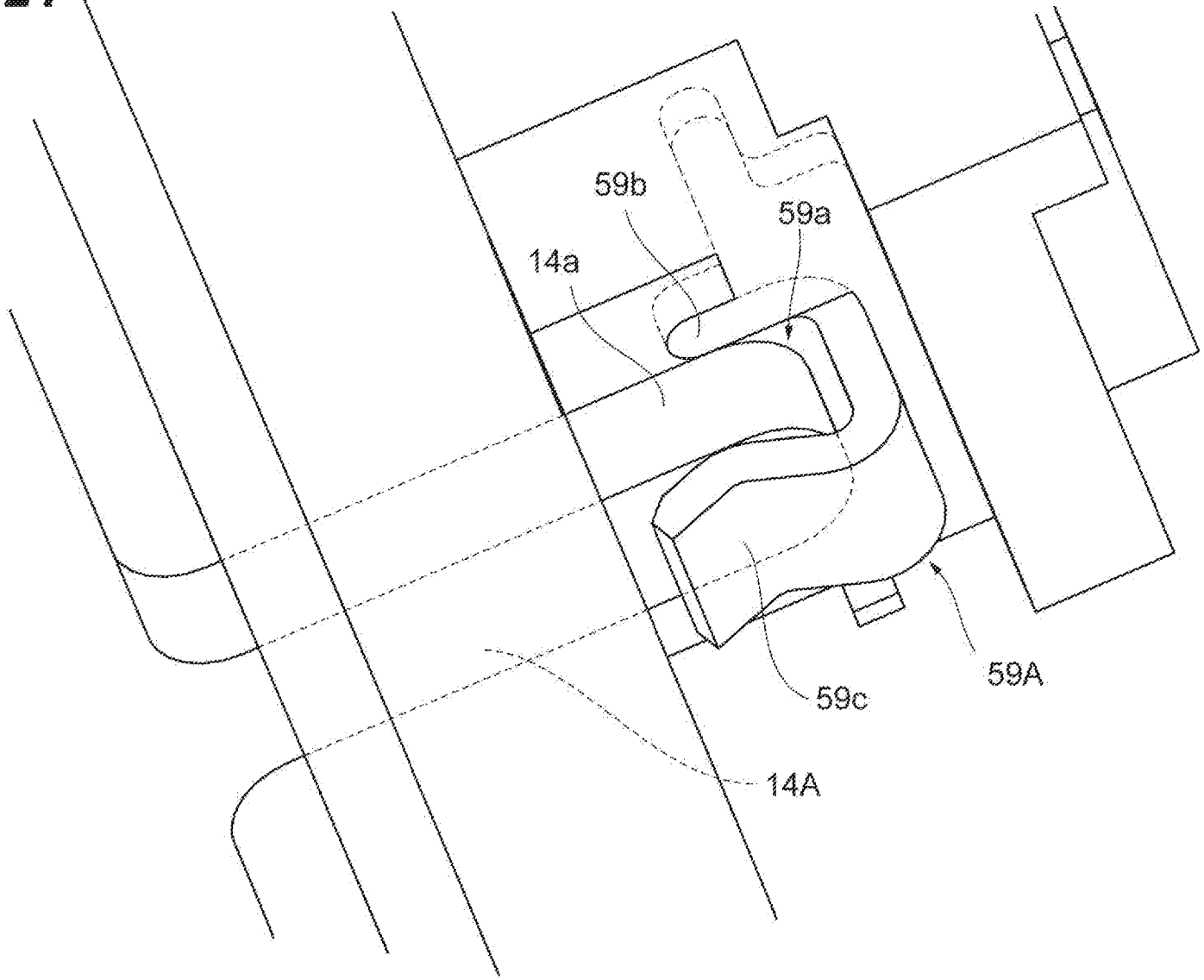
FIG. 21 is a diagram illustrating joining between an extending portion of the shell and a spring portion.

The extending portions 14A and 14B are elongated and equal in width to each other. The extending portions 14A and 14B are inserted through the through holes 84*a* provided in the flange portions 84A and 84B of the main body portion 80, respectively. The flange portions 84A and 84B are positioned in front of spring portions 59A and 59B in the X direction and shield the spring portions 59A and 59B when viewed from the front in the X direction, respectively. As illustrated in FIG. 21, a tip portion 14*a* of the extending portion 14A reaches the spring portion 59A provided on the back ground plate 58 held by the main body portion 80 via the through hole 84*a* of the flange portion 84A. The tip portion 14*a* of the extending portion 14A is elastically joined to the spring portion 59A. Specifically, the tip portion 14*a* of the extending portion 14A is accommodated in a U-shaped recessed portion 59*a* of the spring portion 59A and is urged in the Y direction and clamped between a base body portion 59*b* and an urging portion 59*c* of the spring portion 59A. The shell 10 reaches ground potential by the tip portion 14*a* of the extending portion 14A coming into contact with the spring portion 59A. Although not illustrated, a tip portion 14*b* of the extending portion 14B reaches the spring portion 59B via the through hole 84*a* of the flange portion 84B and is elastically joined to the spring portion 59B as in the case of the tip portion 14*a* of the extending portion 14A described above. Description of the manner of joining the tip portion 14*b* of the extending portion 14B and the spring portion 59B to each other, which is similar to the manner of joining the tip portion 14*a* of the extending portion 14A and the spring portion 59A to each other, will be omitted. In the present embodiment, each of the extending portions 14A and 14B may be bonded by welding or the like although no permanent bonding is performed between the spring portions 59A and 59B and the back ground plate 58.

By means of the conductive shell 10 described above, it is possible to suppress a situation in which the connector assembly 30 is affected by electromagnetic waves from the outside and a situation in which electromagnetic wave noise generated in the connector assembly 30 affects an electronic device around the electrical connector 1.

Figure 2:
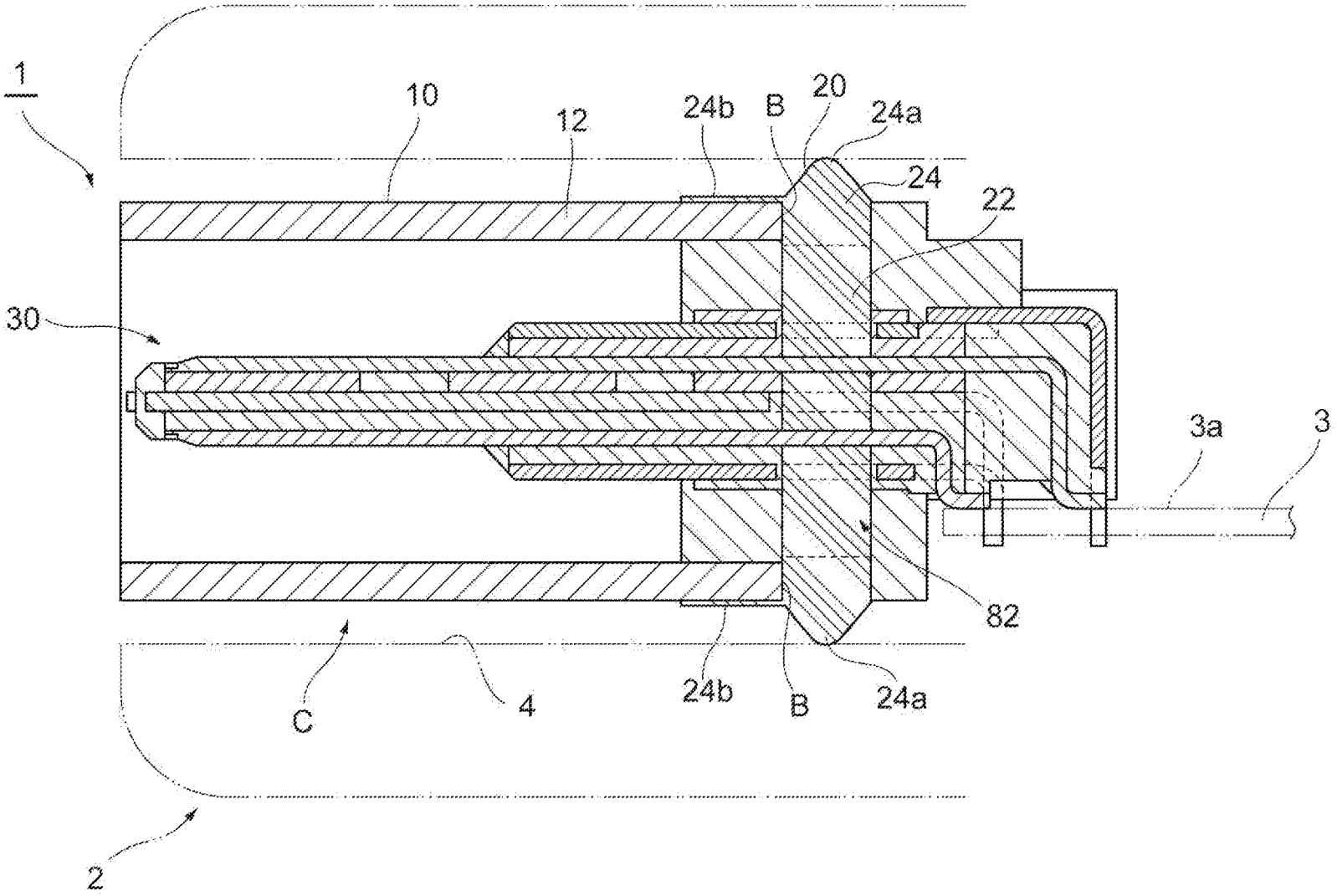
FIG. 2 is a cross-sectional view taken along line II-II of the electrical connector in FIG. 1.

As illustrated in FIG. 2, the waterproof member 20 has an internal waterproof portion 22 and an external waterproof portion 24 configured to be integrated with each other. The waterproof member 20 is obtained by the connector assembly 30 to which the shell 10 is attached being disposed in a predetermined mold, the opening 82 of the main body portion 80 being filled with an insulating resin, and molding being performed such that the outer periphery of the main body portion 80 is surrounded. The resin that is used for the waterproof member 20 may be elastic to some extent. The resin is, for example, silicone rubber.

The internal waterproof portion 22 is a part with which the opening 82 of the main body portion 80 is filled. The internal waterproof portion 22 covers the part of each contact 40 and each ground plate 50 that is exposed from the opening 82 of the main body portion 80. Specifically, as illustrated in FIGS. 2 and 4, the internal waterproof portion 22 covers the exposed portions 42*c* and 44*c* of the upper contact 42 and the lower contact 44, a part of the arm portion 52*b* of the intermediate ground plate 52, a part of the bridge portion 54*b* of the upper ground plate 54, and a part of the bridge portion 56*b* of the lower ground plate 56. In this manner, the internal waterproof portion 22 covers all of the contact 40 and the ground plate 50 held by both the connecting portion 70 and the main body portion 80 in the opening 82, and thus a situation in which moisture reaches the rear end of the main body portion 80 from the connecting portion 70 through the contact 40 and the ground plate 50 is suppressed.

As illustrated in FIG. 1, the external waterproof portion 24 is an annular part that surrounds the entire circumference of the main body portion 80 which is perpendicular to the X direction. As illustrated in FIG. 2, the external waterproof portion 24 has a substantially triangular cross section tapered away from the main body portion 80 in the Z direction. In terms of dimension and shape, the external waterproof portion 24 is designed such that a top portion 24*a* of the external waterproof portion 24 is capable of abutting against an inner wall 4 of the accommodating space C of the electronic device 2 over the entire circumference.

The external waterproof portion 24 has a thin film portion 24*b* that thinly covers the surface of the rear end of the tube portion 12 of the shell 10. The thin film portion 24*b* is provided integrally with respect to the external waterproof portion 24 and covers an interface B between the rear end surface of the tube portion 12 and the waterproof member 20 over the entire circumference.

As described above, the electrical connector 1 is provided with the waterproof member 20 having the internal waterproof portion 22 and the external waterproof portion 24 in the main body portion 80, and the internal waterproof portion 22 and the external waterproof portion 24 are integrated with each other. Accordingly, the internal waterproof portion 22 covers the exposed portions 42*c* and 44*c* of the upper contact 42 and the lower contact 44 in the opening 82 of the main body portion 80, and rearward water immersion of the main body portion 80 along the upper contact 42 and the lower contact 44 is prevented. In addition, the external waterproof portion 24 surrounds the entire circumference of the main body portion 80 and prevents water immersion between the electrical connector 1 and the inner wall 4 of the accommodating space C of the electronic device 2. Since the internal waterproof portion 22 and the external waterproof portion 24 are integrated as described above, both internal waterproofing and external waterproofing can be realized with the simple configuration of the single waterproof member 20 in the electrical connector 1 described above.

Accordingly, assembly work can be simpler than in a case where an internal waterproofing member and an external waterproofing member are combined with each other so that both internal waterproofing and external waterproofing are realized. As a result, manufacturing cost reduction and manufacturing facility efficiency improvement can be achieved.

It should be noted that the waterproof member 20 does not necessarily have to be made of a single material and a configuration using a plurality of materials (such as two-color molding) may be adopted for the waterproof member 20 insofar as the internal waterproof portion 22 and the external waterproof portion 24 are integrated with each other in the configuration.

The electrical connector 1 described above does not necessarily have to be provided with both the upper contact 42 and the lower contact 44. The electrical connector 1 described above may be configured to be provided with either the upper contact 42 or the lower contact 44. In addition, in the electrical connector 1, the number of contacts constituting the upper contact 42 and the lower contact 44 can be appropriately increased or decreased. Further, each of the ground plates 50 is optional and a configuration lacking, for example, the intermediate ground plate 52 can be adopted as well. Also, the electrical connector 1 may be configured without the shell 10.

In the electrical connector 1, the tube portion 12 is firmly fitted to the front main body portion 86 of the main body portion 80 by the rear end of the shell 10 being fitted to the front end (front main body portion 86) of the main body portion 80 with the front main body portion 86 inclined such that the outer shape dimension of the front main body portion 86 to be joined to the rear end of the tube portion 12 of the shell 10 expands rearward from the front in the direction of connection (X direction).

The thin film portion 24*b* of the external waterproof portion 24 covers the interface B between the rear end surface of the tube portion 12 and the waterproof member 20 over the entire circumference, and thus a situation in which water intrudes into the electrical connector 1 from the interface B is significantly suppressed. In addition, the water immersion path that reaches the interface B can be extended to the same extent as the width (X-direction length) of the thin film portion 24*b*, and thus no water is likely to intrude into the electrical connector 1.

In the electrical connector 1, the connecting portion 70 has the first resin 62 (first resin portion) holding the lower contact 44 with respect to the intermediate ground plate 52 and the second resin 64 (second resin portion) holding the upper contact 42 with respect to the intermediate ground plate 52 and separate from the first resin 62. Also provided is the third resin 66 (third resin portion) covering the first resin 62 and the second resin 64 and separate from the first resin 62 and the second resin 64.

As described above, the first resin 62 is for lied by the first insert molding (Step S1 in FIG. 12) and the second resin 64 is formed by the second insert molding (Step S2 in FIG. 12).

Deflection of the lower contact 44 can be suppressed by a predetermined mold being used during the first insert molding. Specifically, a situation in which the lower contact 44 deflects toward the intermediate ground plate 52 is suppressed by a mold that has a part which can be inserted through the through hole 53 provided in the intermediate ground plate 52 being used and insert molding being performed in a state where the lower contact 44 is held by the mold. Also during the second insert molding, deflection of the upper contact 42 can be suppressed by a predetermined mold being used. During the second insert molding, the intermediate ground plate 52 is not integrated, and thus the upper contact 42 is unlikely to deflect.

The disposition and the shape of the mold that is used for each molding step can be appropriately changed based on the above-described division into the first insert molding (step for molding the first molded body 32) and the second insert molding (step for molding the second molded body 34). As a result, deflection of the upper contact 42 and the lower contact 44 can be suppressed. Accordingly, the upper contact 42 and the lower contact 44 are capable of realizing a high level of relative positional accuracy with respect to the intermediate ground plate 52.

During the first insert molding, a part of the mold is inserted from above through the through hole 53 provided in the plate-shaped portion 52*a* of the intermediate ground plate 52 and the lower contact 44 can be held so as not to deflect upward. In a case where the intermediate ground plate 52 is integrated during the second insert molding without being integrated during the first insert molding, the upper contact 42 can be held so as not to deflect downward by a part of the mold being inserted from below through the through hole 53 during the second insert molding.

The first resin 62, the second resin 64, and the third resin 66 may be resin materials of the same type or resin materials of different types.

In the electrical connector 1, the shell 10 has the tube portion 12 and the extending portions 14A and 14B. The extending portions 14A and 14B are elastically connected to the spring portion 59 by extending to the spring portion 59 (ground member) of the back ground plate 58 of the main body portion 80.

The shell 10 and the back ground plate 58 can be electrically connected to each other by the extending portions 14A and 14B of the shell 10 being elastically joined to the spring portion 59 of the back ground plate 58. In other words, the shell 10 and the back ground plate 58 can be electrically interconnected with a simple configuration without welding. As a result, the electrical connector 1 can be relatively inexpensive. In the electrical connector according to the related art, electrical connection between a shell and a back shell (back ground plate) is realized by welding, and thus pre-welding electrical connection is insufficient and initial electrical connection is possible after the welding. Accordingly, in the electrical connector according to the related art, insufficient electrical connection may arise in the event of a shell-back shell welding problem. In the electrical connector 1 described above, in contrast, insufficient electrical connection attributable to a welding problem does not occur and the shell 10 and the back ground plate 58 can be electrically interconnected with reliability.

In the electrical connector 1, the shell 10 and the back ground plate 58 are not welded to each other, and thus no welding facility is necessary and manufacturing cost reduction can be achieved. In addition, welding work-related labor and time can be reduced and manufacturing efficiency improvement can be achieved.

REFERENCE SIGNS LIST

1: electrical connector, 2: electronic device, 3: substrate, 4: inner wall, 10: shell, 12: tube portion, 14A, 14B: extending portion, 20: waterproof member, 22: internal waterproof portion, 24: external waterproof portion, 30: connector assembly, 32: first molded body, 34: second molded body, 36: molded body set, 40, 42, 44: contact, 42*c*, 44*c*: exposed portion, 50, 52, 54, 56, 58: ground plate, 59, 59A, 59B: spring portion, 60: resin molded body, 62: first resin, 64: second resin, 66: third resin, 70: connecting portion, 80: main body portion, 82: opening, 84A, 84B: flange portion, 84*a*: through hole, C: accommodating space.

The invention claimed is:

1. An electric connector comprising:

a connecting portion configured to be connected with an opposite connector;

a main body portion positioned behind the connecting portion in a direction of connection with the opposite connector;

a conductive contact extending from the main body portion along the direction of connection and held by both the connecting portion and the main body portion, wherein an opening is formed in the main body portion that creates an exposed portion of the conductive contact;

a removable conductive shell that surrounds the connecting portion and that extends in the direction of connection, wherein a tubular-shaped interface of the removable conductive shell is connected to the main body portion; and a waterproof member having an internal waterproof portion and an external waterproof portion integrally formed together as a single unitary body, wherein the internal waterproof portion fills the opening of the main body portion and covers the exposed portion of the conductive contact exposed from the opening to waterproof an interior of the electric connector, and wherein the external waterproof portion has an annular shape and surrounds an entire circumference of the main body portion, the external waterproof portion contacting the tubular-shaped interface of the removable conductive shell and forming a raised waterproof seal that extends perpendicularly to the direction of connection outside an exterior surface of the removable conductive shell to waterproof an exterior of the electric connector.

2. The electric connector according to claim 1, further comprising:

a conductive member having a plate shape that extends from the main body portion along the direction of connection and is held by the connecting portion;

a first set of conductive contacts spaced apart and electrically insulated from a front side of the conductive member, the first set of conductive contacts extending from the main body portion along the direction of connection and held by the connecting portion; and a second set of conductive contacts spaced apart and electrically insulated from a back side of the conductive member, the second set of conductive contacts extending from the main body portion along the direction of connection and held by the connecting portion, wherein the conductive member is located between the first set of conductive contacts and the second set of conductive contacts.

3. The electric connector according to claim 2, wherein the plate shape of the conductive member extends from the main body portion, wherein an exposed portion of the conductive member is created by the opening of the main body portion, and wherein the internal waterproof portion of the waterproof member that fills the opening of the main body portion covers the exposed portion of the conductive member.

4. The electric connector according to claim 1, wherein a rear end of the removable conductive shell includes the tubular-shaped interface fitted to a front end of the main body portion, and wherein an outer shape dimension of a fitting part in the front end of the main body portion increases rearward in the direction of connection.

5. The electric connector according to claim 4, wherein the external waterproof portion of the waterproof member covers at least a part of each of the rear end of the removable conductive shell and the front end of the main body portion that are fitted together.

6. The electric connector according to claim 5, wherein the external waterproof portion comprises:

a thin film portion that extends in the direction of connection and covers the rear end of the removable conductive shell; and a tapered portion that extends outside the exterior surface of the removable conductive shell.

7. The electric connector according to claim 2, wherein a first resin layer is located between the first set of conductive contacts and the front side of the conductive member, and wherein a second resin layer is located between the second set of conductive contacts and the back side of the conductive member.

8. The electric connector according to claim 7, wherein the first and second resin layers are not formed in the opening of the main body portion.

9. The electric connector according to claim 3, further comprising an upper conductive member located between the first set of conductive contacts and the removable conductive shell, wherein the upper conductive member extends from the main body portion along the direction of connection and is held by the connecting portion, wherein an exposed portion of the upper conductive member is created by the opening of the main body portion, and wherein the internal waterproof portion of the waterproof member that fills the opening of the main body portion covers the exposed portion of the upper conductive member.

10. The electric connector according to claim 9, wherein the upper conductive member is spaced apart and electrically insulated from the first set of conductive contacts by a resin layer.

11. The electric connector according to claim 9, further comprising a lower conductive member located between the second set of conductive contacts and the removable conductive shell, wherein the lower conductive member extends from the main body portion along the direction of connection and is held by the connecting portion, wherein an exposed portion of the lower conductive member is created by the opening of the main body portion, and wherein the internal waterproof portion of the waterproof member that fills the opening of the main body portion covers the exposed portion of the lower conductive member.

12. The electric connector according to claim 11, wherein the upper conductive member is spaced apart and electrically insulated from the first set of conductive contacts by a first resin layer, wherein the lower conductive member is spaced apart and electrically insulated from the second set of conductive contacts by a second resin layer, and wherein the first and second resin layers are not formed in the opening of the main body portion.

13. The electric connector according to claim 2, further comprising a ground plate embedded in the main body portion, the ground plate comprising a first portion extending in the direction of connection above the first set of conductive contacts and a second portion bent orthogonal to the direction of connection to provide an electromagnetic shield of the first set of conductive contacts and the second set of conductive contacts.

14. The electric connector according to claim 13, wherein the ground plate includes two spring portions connected to the first portion that are located on opposite sides of the main body portion, and wherein the removable conductive shell includes two extending portions which engage with the two spring portions to releasably connect the removable conductive shell to the main body portion.

15. The electric connector according to claim 14, wherein the removable conductive shell reaches ground potential by contacting the two spring portions of the ground plate.

16. The electric connector according to claim 15, wherein the removable conductive shell provides an additional electromagnetic shield of the first set of conductive contacts and the second set of conductive contacts.

17. The electric connector according to claim 14, wherein the main body portion includes two through holes, and wherein the two extending portions are inserted into the two through holes in order to engage with the two spring portions.

18. The electric connector according to claim 1, wherein the external waterproof portion extends outside the exterior surface of the removable conductive shell to abut against an inner wall of an electronic device, the electric connector configured to be mounted within an accommodating space bounded by the inner wall of the electronic device.

19. An electronic device including the electric connector according to claim 2, wherein the external waterproof portion extends outside the exterior surface of the removable conductive shell to abut against an inner wall of the electronic device, the electric connector mounted within an accommodating space bounded by the inner wall of the electronic device, the electronic device comprising a substrate, wherein each conductive contact in the first set of conductive contacts and the second set of conductive contacts includes a bent portion located in the main body portion that is electrically connected to the substrate.

20. The electronic device according to claim 19, further comprising a ground plate embedded in the main body portion and located above the first set of conductive contacts, the ground plate comprising a first portion extending in the direction of connection and a second portion bent orthogonal to the direction of connection toward the substrate, wherein the removable conductive shell is connected to the ground plate to shield the electronic device from electromagnetic waves generated in the electric connector.

* * * * *